US008408535B2

(12) United States Patent
Miki

(10) Patent No.: US 8,408,535 B2
(45) Date of Patent: Apr. 2, 2013

(54) ATTACHMENT ASSIST DEVICE AND IMAGE FORMING APPARATUS EMPLOYING THE ATTACHMENT ASSIST DEVICE

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 77 days.

(21) Appl. No.: 12/805,581

(22) Filed: Aug. 6, 2010

(65) Prior Publication Data

US 2011/0031681 A1 Feb. 10, 2011

(30) Foreign Application Priority Data

Aug. 7, 2009 (JP) ..... 2009-184294

(51) Int. Cl.
*B65H 1/00* (2006.01)

(52) U.S. Cl. ..... 271/162; 271/145; 271/164

(58) Field of Classification Search ..... 271/162, 271/164, 145
See application file for complete search history.

(56) References Cited

U.S. PATENT DOCUMENTS

| | | | | |
|---|---|---|---|---|
| 5,823,525 | A * | 10/1998 | Miki | 271/127 |
| 6,820,872 | B2 * | 11/2004 | Ko et al. | 271/162 |
| 7,469,892 | B2 * | 12/2008 | Iwase et al. | 271/164 |
| 8,002,269 | B2 * | 8/2011 | Asada et al. | 271/145 |
| 2004/0188922 | A1 | 9/2004 | Takahashi et al. | |

FOREIGN PATENT DOCUMENTS

| | | | |
|---|---|---|---|
| CN | 1534394 | A | 10/2004 |
| JP | S59-073644 | | 5/1984 |
| JP | H05-061830 | | 8/1998 |
| JP | 2006-151687 | A | 6/2006 |
| JP | 2007-070068 | A | 3/2007 |
| JP | 2007-132605 | A | 5/2007 |
| JP | 2007-260011 | A | 10/2007 |
| JP | 2008-127110 | A | 6/2008 |

OTHER PUBLICATIONS

Chinese Office Action dated Aug. 2, 2012 for corresponding Chinese Application No. 201010248481.X.

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

An attachment assist device includes an engaging member, an engaged member, a drawing-force generator, biasing members, and rotational members. The engaging member is provided at one of a main unit and a sub unit detachably attached to the main unit. The engaged member is engaged by the engaging member and provided at the other of the main unit and the sub unit. The drawing-force generator generates a drawing force to draw the sub unit into an interior of the main unit. The biasing members are provided at the drawing-force generator to generate biasing forces in different directions. The rotational members are provided rotatably around support points at the drawing-force generator and engaged with the biasing members. The biasing members are serially connected with the rotational members to convert the biasing forces of the biasing members to the drawing force.

15 Claims, 15 Drawing Sheets

ATTACHMENT ASSIST DEVICE AND IMAGE FORMING APPARATUS EMPLOYING THE ATTACHMENT ASSIST DEVICE

CROSS-REFERENCE TO RELATED APPLICATIONS

The present patent application claims priority pursuant to 35 U.S.C. §119 from Japanese Patent Application No. 2009-184294, filed on Aug. 7, 2009 in the Japan Patent Office, which is incorporated herein by reference in its entirety.

BACKGROUND OF THE DISCLOSURE

1. Field of the Disclosure

Exemplary embodiments of the present disclosure relate to an attachment assist device and an image forming apparatus including the attachment assist device, and more specifically, an attachment assist device including an attachment assist unit that assists attachment of a sub unit to a main unit, and an image forming apparatus including the attachment assist device.

2. Description of the Background

In general, electrophotographic image forming apparatuses, such as copiers, printers, facsimile machines, or multifunction devices including at least two of those capabilities, include a reading unit to read image data from a document, an image forming unit to form images on sheets of recording media according to the image data read by the reading unit, and a sheet feeder to feed the sheets to the image forming unit. The image forming unit further includes an optical writing device to direct a writing light (e.g., laser beam) onto a surface of an image carrier (e.g., a photoconductor), thus forming an electrostatic latent image thereon, and a development device to develop the latent image with toner. In multicolor image formation, the image forming unit forms cyan, magenta, yellow, and black toner images on a single photoconductor or multiple respective photoconductors, which are then transferred therefrom and superimposed one on another on the sheet, thus forming a multicolor image.

Image forming apparatuses further include a sheet tray that can store multiple sheets and be retracted into and pulled out from a main unit. Such image forming apparatuses include a pick-up mechanism such as a pick-up roller or the like to sequentially pick up the sheets stored in the sheet tray from the top of the stack of sheets. Such image forming apparatuses feed the sheets one at a time with the pick-up device to form images on the sheets in the image forming unit.

In such image forming apparatuses, if the sheet tray is not properly positioned in the sheet feeder or main unit in a direction in which the sheet tray is properly inserted into the main unit (hereinafter "insertion direction"), the image forming apparatus may form a substandard image on the sheet, with the image deviating laterally from the center of the sheet in a width direction of the sheet.

An additional problem can arise when the sheet tray is empty or a user desires to change the sheet size or the like, the user pulls the sheet tray out of the main unit, fills the sheet tray with sheets, and then pushes the sheet tray back into the main unit. However, the sheet tray when filled with sheets is relatively heavy, imposing a correspondingly burden on the user who tries to push the sheet tray into the main unit. Further, if the weight of the sheet tray causes the user to handle the sheet tray with undue force, the impact upon attachment of the sheet tray to the sheet feeder may displace the sheets stored in the sheet tray, or damage the sheet tray itself.

To deal with such a failure, several conventional techniques like those described in JP-2006-151687-A, JP-2007-070068-A, and JP-2007-260011-A have been proposed. For example, an attachment assist device draws the sheet tray to an attachment position at which the sheet tray is attached to the main unit. When the sheet tray is pushed to a certain position in its attachment direction, an engaged portion of the sheet tray is engaged with an engaging portion of the attachment assist device. As a result, the attachment assist device draws the sheet tray to the attachment position while regulating the movement speed of the sheet tray.

However, the size of the attachment assist device is large relative to the distance at which the attachment assist device can draw the sheet tray to the attachment position, resulting in an increased size of the main unit to which the attachment assist device is attached.

Further, for conventional techniques like those described in JP-2006-151687-A and JP-2007-070068-A, when the engaged portion of the sheet tray is engaged with the engaging portion of the attachment assist device, the attachment assist device continues to apply substantially uniform regulation forces to the sheet tray until drawing of the sheet tray is completed. Such a configuration needs to create a great amount of damper torque to sufficiently reduce the attachment speed of the sheet tray and increase a biasing force for drawing the sheet tray in the drawing direction, causing an increased burden when a user pulls the sheet tray out of the main unit. Further, for a conventional technique like that described in JP-2007-260011-A, the regulation force is applied to the sheet tray up to the sheet tray approaching an attachment end position at which attachment of the sheet tray is completed but not beyond, causing unrestrained impact to the main unit.

Further, in the above-described conventional techniques, in a case in which the engaged portion is not engaged with the engaging portion even though the sheet tray is drawn into the main unit by the attachment assist device, the sheet tray may not be able to be returned to its normal state by ordinary operation.

SUMMARY

In at least one exemplary embodiment, there is provided an improved attachment assist device that draws a detachably attachable sub unit from a drawing start position to a drawing end position in an interior of a main unit. The attachment assist device includes an engaging member, an engaged member, a drawing-force generator, a plurality of biasing member, and a plurality of rotational members. The engaging member is provided at one of the main unit and the sub unit. The engaged member is engaged by the engaging member and provided at the other of the main unit and the sub unit. On engagement of the engaging member with the engaged member at the drawing start position, the drawing-force generator generates a drawing force to draw the sub unit to the drawing end position in the interior of the main unit. The plurality of biasing members is provided at the drawing-force generator to generate biasing forces in different directions. The plurality of rotational members is provided rotatably around a support point at the drawing-force generator and engaged with the plurality of biasing members. The plurality of biasing members is serially connected with the plurality of rotational members to convert the biasing forces of the plurality of biasing members to the drawing force.

In at least one exemplary embodiment, there is provided an improved image forming apparatus including a sheet tray, a sheet feeder, an image forming unit, and an attachment assist device. The sheet tray is detachably attached to the image forming apparatus to stack a plurality of recording sheets thereon. The sheet feeder feeds the recording sheets stacked on the sheet tray. The image forming unit forms images on the recording sheets fed with the sheet feeder. The attachment assist device draws the sheet tray from a drawing start position to a drawing end position in an interior of the image forming apparatus and includes an engaging member, an engaged member, a drawing-force generator, a plurality of biasing members, and a plurality of rotational members. The engaging member is provided at one of the main unit and the sub unit. The engaged member is engaged by the engaging member and provided at the other of the main unit and the sub unit. On engagement of the engaging member with the engaged member at the drawing start position, the drawing-force generator generates a drawing force to draw the sub unit to the drawing end position in the interior of the main unit. The plurality of biasing members is provided at the drawing-force generator to generate biasing forces in different directions. The plurality of rotational members is provided rotatably around a support point at the drawing-force generator and engaged with the plurality of biasing members. The plurality of biasing members is serially connected with the plurality of rotational members to convert the biasing forces of the plurality of biasing members to the drawing force.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
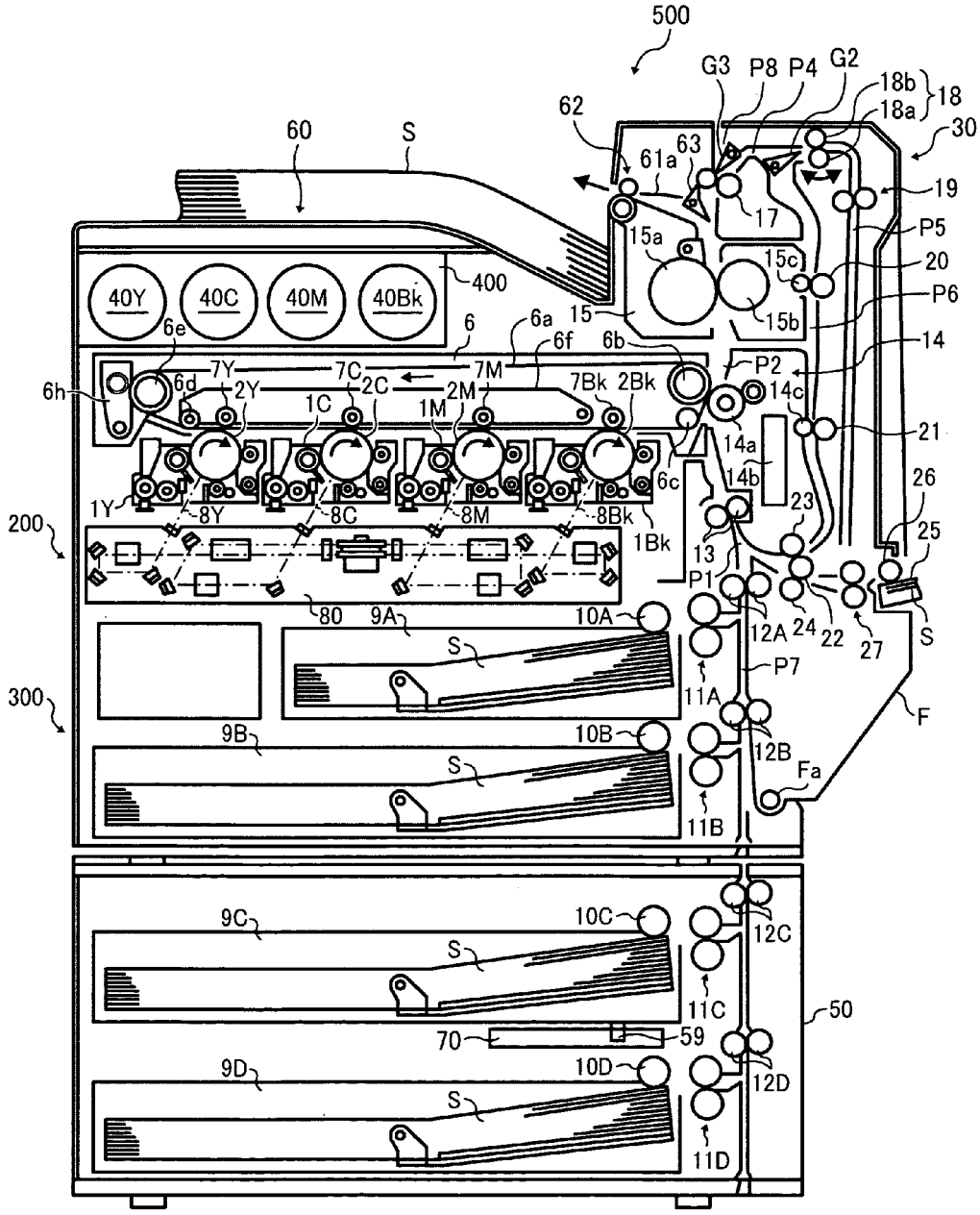
FIG. 1 is a schematic view illustrating a configuration of a printer according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views thereof, and particularly to FIG. 1, an image forming apparatus 500 according to an exemplary embodiment of the present disclosure is described.

It is to be noted that, in the description below, reference characters Y, M, C, and BK attached to the end of each reference numeral indicate only that components indicated thereby are used for forming yellow, magenta, cyan, and black images, respectively, and hereinafter may be omitted when color discrimination is not necessary.

As illustrated in FIG. 1, the image forming apparatus 500 according to the present exemplary embodiment is described as a tandem-type multicolor laser printer (hereinafter simply "printer") including multiple photoconductors arranged in parallel to each other. However, the image forming apparatus is not limited to the tandem-type multicolor laser printer and may be another type of printer, a copier, a facsimile machine, or a multifunction device having at least two of the foregoing capabilities.

As illustrated in FIG. 1, the printer 500 includes an image forming section 200, a sheet feeder 300 to feed sheets S of recording media to the image forming section 200. The image forming section 200 includes four image forming units 1Y, 1C, 1M, and 1BK for forming yellow (Y), cyan (C), magenta (M), and black (BK) images, respectively. The image forming units 1Y, 1C, 1M, and 1BK include drum-shaped photoconductors 2Y, 2M, 2C, and 2BK, respectively, arranged at constant intervals in a lateral direction in FIG. 1. Each photoconductor 2 rotates clockwise in FIG. 1 as indicated by an arrow shown in FIG. 1, driven by a driving source, not shown, when the printer 500 is activated. Each image forming unit 1 further includes image forming components, such as a development device for electrophotographic image formation, provided around the photoconductor 2. The image forming units 1Y, 1C, 1M, and 1BK have similar configurations except for the color of toner used therein, and thus only the image forming unit 1Y is described below in further detail with reference to FIG. 2.

Figure 2:
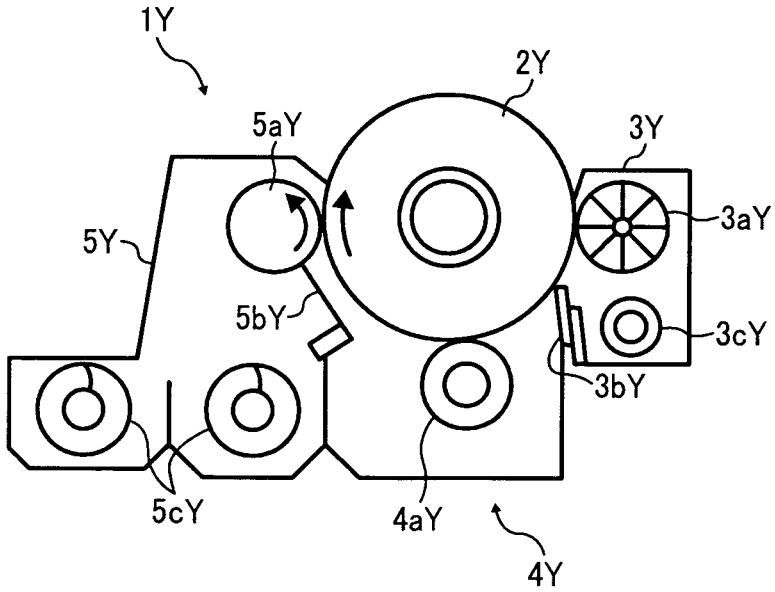
FIG. 2 is a schematic view illustrating a configuration of an image forming unit for forming yellow'toner images of the printer shown in FIG. 1.

FIG. 2 is a schematic view illustrating the image forming unit 1Y for yellow included in the printer 500 shown in FIG. 1.

As shown in FIG. 2, in the yellow image forming unit 1Y, as the image forming components, a charger 4Y, a development device 5Y, a cleaning unit 3Y are disposed around the photoconductor 2Y clockwise in that order according to the sequence of electrostatic image forming processes. The charger 4Y includes a charging roller 4*a*Y and charges the photoconductor 2Y according to data of an image to be formed on the photoconductor 2Y. The development device 5Y includes a development roller 5*a*Y, a development blade 5*b*Y, and screws 5*c*Y and supplies toner to the photoconductor 2Y charged. The cleaning unit 3Y includes a cleaning brush 3*a*Y, a cleaning blade 3*b*Y, and a collection screw 3*c*Y and removes toner from the photoconductor 2Y.

The photoconductor 2Y includes a cylindrical aluminum base having a diameter of within a range from approximately 30 mm to 120 mm and a photosensitive organic semiconductor layer overlying a surface of the aluminum base, for example. It is to be noted that the photoconductor 2Y is not limited to the cylindrical shape and may be, for example, a belt shape.

Referring to FIG. 1, an exposure unit 80 is provided below the photoconductors 2. The exposure unit 80 serves as a latent image forming unit and scans uniformly-charged surfaces of the respective photoconductors 2 with respective laser beams 8 according to image data of respective colors, thus forming electrostatic latent images thereon. In each image forming unit 1, a slot extending in a direction parallel to an axis of rotation of the photoconductor 2 is formed between the charger 4 and the development device 5 so that the laser beam 8 emitted from the exposure unit 80 can reach the photoconductor 2.

The exposure unit 80 shown in FIG. 1 is a laser scanning type and includes four semiconductor laser light sources, a polygon mirror, and the like although not shown in FIG. 1. From the four semiconductor light sources, the exposure unit 80 emits the laser beams 8 modulated according to the image data to the corresponding photoconductors 2. The exposure unit 80 includes a metal or resin frame that houses optical components and control-related components, and a translucent dustproof member is provided at a light emission port on its upper surface. It is to be noted that, although the printer 500 shown in FIG. 1 includes the single exposure unit 80, alternatively, multiple individual exposure units may be provided for the respective image forming units 1. Additionally, the exposure unit 80 can employ known light emitting diode (LED) arrays and an imaging component (e.g., converging lens) in combination instead of the semiconductor laser light sources. In this case, several thousands to several tens of thousands of micromachined LED are lined, and thus optical writing is performed with the LEDs corresponding to respective dots forming the latent image on the photoconductor 2. That is, the optical system requires only a simple converging lens, obviating a mechanical driving system such as a polygon mirror, and thus reliability can be enhanced while reducing the cost as well as the size of the exposure unit 80.

Yellow, cyan, magenta, and black toners are consumed in image development performed by the respective development devices 5, and toner detectors, not shown, detect the amount or concentration of toner in the respective development devices 5. Four toner cartridges 40Y, 40C, 40M, and 40BK are provided in an upper portion of the printer 500, and the respective color toners are supplied from the toner cartridges 40Y, 40C, 40M, and 40BK by toner supply devices, not shown, to the development devices 5. An exterior of each toner cartridge 40 is formed as a container made of, for example, resin or paper and a discharge port is formed therein. Each toner cartridge 40 is configured to facilitate attachment and removal of the toner cartridge 40 from an attachment portion 400 provided in the upper portion of the printer 500. When the toner cartridge 40 is attached to the attachment portion 400, the discharge port formed in the toner cartridge 40 is connected to a toner supply member provided in a main unit of the printer 500. The printer 500 also includes a preventive of errors in attachment of the toner cartridges 40 because wrong color toner is supplied to the development device 5 if the toner cartridge 40 is attached at a wrong position. For example, the toner cartridges 40 may be different in shape so that each toner cartridge 40 can match only the position of corresponding color in the attachment portion 400.

Each development device 5 includes two screws 5*c* for agitating toner and carrier and transporting developer including the toner and the carrier. When the development device 5 is installed in the printer 500, one end of the toner supply member is connected to an upper portion of the screw 5*c* on the left in FIG. 2. Referring to FIG. 2, the toner is supplied by the screws 5*c* to the development roller 5*a* rotating counterclockwise in FIG. 2, and the development blade 5*b* adjusts the thickness of a toner layer on a circumferential surface of the development roller 5*a* to a predetermined or given thickness. The development roller 5*a* includes a stainless steel or aluminum sleeve rotatably fixed to a frame (not shown) of the development device 5 so that a constant distance is maintained between the photoconductor 2 and the development roller 5*a*, and the sleeve contains magnets that form predetermined magnetic force lines. The electrostatic latent image formed on each photoconductor 2 by the corresponding laser beam 8 is developed by the development device 5 using the corresponding color toner.

Referring to FIG. 1, the printer further includes an intermediate transfer unit 6 disposed above the photoconductors 2. The intermediate transfer unit 6 includes an intermediate transfer belt 6*a*, serving as an image carrier, stretched around a secondary-transfer counter roller 6*b*, rollers 6*c* and 6*d*, and a cleaning counter roller 6*e*. As the roller 6*b* rotates, driven by a driving source (not shown), the intermediate transfer belt 6*a* rotates counterclockwise in FIG. 1 as indicated by an arrow shown in FIG. 1. The intermediate transfer belt 6*a* is an endless belt and positioned so that the surface of each photoconductor 2 can contact the intermediate transfer belt 6*a* after passing an area facing the development device 5. Four primary-transfer rollers 7 are provided on an inner circumferential side of the intermediate transfer belt 6*a* at positions facing the respective photoconductors 2.

A belt cleaning unit 6*h* is provided on an outer circumferential side of the intermediate transfer belt 6*a* at a position facing the cleaning counter roller 6*e*. The belt cleaning unit 6*h* removes residual toner, paper dust, and the like from a surface of the intermediate transfer belt 6*a*. The cleaning counter roller 6*e* facing the belt cleaning unit 6*h* is movably pressed against the intermediate transfer belt 6*a* at an appropriate pressure to keep the intermediate transfer belt 6*a* taut constantly. The belt cleaning unit 6*h* moves in conjunction with the cleaning counter roller 6*e*.

For example, the intermediate transfer belt 6*a* includes a resin film or rubber base having a thickness within a range of from 50 μm to 600 μm and has a resistivity at which the toner image formed on each photoconductor 2 can be transferred onto the surface of the intermediate transfer belt 6*a* electrostatically with a bias applied to the corresponding primary-transfer roller 7. It is to be noted that the intermediate transfer belt 6*a* and the related components are supported by a common unit to form the intermediate transfer unit 6 detachably attachable to the printer 500. For example, the intermediate transfer belt 6*a* may be a polyamide belt in which carbon is dispersed and have a volume resistivity within a range of approximately 106 Ω·cm to 1012 Ω·cm. Additionally, a rib is formed in at least one end portion in a width direction of the intermediate transfer belt 6*a*, perpendicular to the direction in which the intermediate transfer belt 6*a* rotates, to inhibit the intermediate transfer belt 6*a* from moving in the width direction, thus maintaining reliable rotation of the intermediate transfer belt 6*a*.

For example, each primary-transfer roller 7 includes a metal core (metal roller) and an electrically conductive rubber material overlying the metal roller, and a driving source, not shown, applies a transfer bias to the metal roller. Examples of the electrically conductive rubber material include urethane rubber in which carbon is dispersed to adjust its volume resistivity to about 105 Ω·cm. Alternatively, the primary-transfer roller 7 may be a metal roller without an electrically conductive rubber surface layer. A secondary-transfer unit 14 including a secondary-transfer roller 14*a* is positioned on the right of the intermediate transfer unit 6 in FIG. 1, and a power source 14*b* is provided in the secondary-transfer unit 14.

The secondary-transfer roller 14*a* is disposed on the outer circumferential side of the intermediate transfer belt 6*a* at a position facing, via the intermediate transfer belt 6*a*, the secondary-transfer counter roller 6*b* that supports the intermediate transfer belt 6*a*. For example, the secondary-transfer roller 14*a* includes a metal core (metal roller) and an electrically conductive rubber material overlying the metal roller, and a driving source 14*b* applies a transfer bias to the metal roller. Carbon is dispersed in the electrically conductive rubber material to adjust its volume resistivity to about 107 Ω·cm. The secondary-transfer roller 14*a* contacts the intermediate transfer belt 6*a* at the position facing the secondary-transfer counter roller 6*b*, and thus a secondary-transfer nipping area (a secondary transfer position) is formed between the secondary-transfer roller 14*a* and the intermediate transfer belt 6*a*. In the secondary-transfer nipping area, which is the contact portion between the secondary-transfer roller 14*a* and the intermediate transfer belt 6*a*, the toner image formed on the intermediate transfer belt 6*a* is electrostatically transferred onto the sheet S passing through the nipping area by applying the transfer bias to the secondary-transfer roller 14*a*.

The sheet feeder 300 below the exposure unit 80 includes multiple retractable sheet trays 9A and 9B that can be pulled out to a front side of the printer 500. For example, the number of the sheet trays may be two. The sheet feeder 300 further includes feed rollers 10A and 10B, two pairs of separation rollers 11A and 11B, and two pairs of conveyance rollers 12A and 12B for the sheet trays 9A and 9B, respectively. The sheets S contained in the sheet trays 9A and 9B are selectively sent out as the corresponding one of the feed rollers 10A and 10B rotates. Subsequently, the corresponding one of the pairs of separation rollers 11A and 11B separates the sheets S one by one by, and then the corresponding one of the pairs of conveyance rollers 12A and 12B feeds the sheet S to a feed path P1.

A pair of registration rollers 13 is provided along the feed path P1 to adjust a timing at which the sheet S is sent to the secondary-transfer nipping area. Thus, the sheet S is sent from the pair of registration rollers 13 to the secondary-transfer nipping area formed between the intermediate transfer belt 6*a* and the secondary transfer roller 14*a*.

The printer 500 further includes a manual bypass tray 25, a feed roller 26, a pair of reverse rollers 27 serving as a separator, a reverse roller 22, and a roller 24 disposed facing the reverse roller 22. When not used, the manual bypass tray 25 can be housed in a side frame F that is a part of the main unit of the printer 500 and disposed on a side. The sheet S placed on the top on the manual bypass tray 25 is fed by the feed roller 26 to the pair of reverse rollers 27, which separates the top sheet S from the rest, and then the reverse roller 22 and the roller 24 transport the sheet S through the feed path P1 to the pair of registration rollers 13.

A fixing device 15 including a heater is provided above the secondary-transfer nipping area in FIG. 1. The fixing device 15 includes a fixing roller 15*a* containing the heater and a pressure roller 15*b* pressing the fixing roller 15*a*. It is to be noted that, alternatively, a fixing device employing a belt or an induction heating (IH) mechanism may be used. When a pivotable switchable guide 63 is at the position shown in FIG. 1, the sheet S on which the toner image is fixed is guided by a guide member 61*a* forming a discharge path and discharged by a pair of discharge rollers 62 in a direction indicated by arrow D shown in FIG. 1 onto a discharge tray 60 formed on an upper side of the printer 500.

The printer 500 further includes a duplex unit 30 including sheet paths and rollers to reverse the sheet S and feed sheet S again to the secondary-transfer nipping area for forming images on both sides of the sheet in duplex printing.

More specifically, the duplex unit 30 is housed in the side frame F and includes a switchback path P5, a resupply path P6, the switchable guide 63, a second switchable guide G2, and a third switchable guide G3 to transport the sheet S to the feed path P1 after the toner image is formed on a first surface (e.g., a front side) of the sheet S. The side frame F further contains reverse rollers 18*a* and 18*b* and the reverse roller 22 connected to a driving source, not shown, that can be rotated in reverse by controlling the driving source. The reverse rollers 18*a* and 18*b* face each other and hereinafter also referred to as a pair of reverse rollers 18. The reverse roller 22 is in contact with the rollers 23 and 24, and, when the reverse roller 22 rotates clockwise in FIG. 1, the reverse roller 22 and the roller 24 rotating in conjunction with the reverse roller 22 send out the sheet S from the manual bypass tray 25. Further, when the reverse roller 22 rotates counterclockwise in FIG. 1, the reverse roller 22 and the roller 23 rotating in combination transport the sheet S through the resupply path P6 again toward the pair of registration rollers 13.

When the switchable guide 63 pivots clockwise from the position shown in FIG. 1, the sheet S on which the toner image is fixed is guided by a pair of rollers 17 to a reverse path P4, guided by the second switchable guide G2 to the pair of reverse rollers 18, and transported to the switchback path P5. After the sheet S is sent to the switchback path P5, the reverse roller 18*a* as well as the second switchable guide G2 rotate counterclockwise in FIG. 1, thereby transporting the sheet S from the switchback path P5 to the resupply path P6. Subsequently, a pair of rollers 15*c* and 20 and a pair of rollers 14*c* and 21 transport the sheet S through the resupply path P6, and the reverse roller 22 and the roller 23 transport the sheet S to the pair of registration rollers 13.

The printer 500 further includes a sheet feeder 50 disposed below the sheet feeder 300 as an additional sheet feed unit. The sheet trays 9C and 9D are provided with feed rollers 10C and 10D, respectively, and the sheet feeder 50 further includes separation rollers 11C and 11D for the sheet trays 9A and 9B and two pairs of conveyance rollers 12C and 12C. Although the sheet feeder 50 shown in FIG. 1 includes two sheet trays 9C and 9D, the total sheet containing capacity of the sheet feeder 50 may be increased by increasing the number of sheet trays or the capacity of each sheet tray.

In the printer 500, when the third switchable guide G3, positioned above the fixing device 15 and downstream from the pair of rollers 17 in a direction in which the sheet S is transported (hereinafter "sheet conveyance direction), pivots counterclockwise from the position shown in FIG. 1, the sheet S on which the toner image is fixed is guided to a discharge path P8, and thus the sheet S can be discharged to a discharge unit (not shown) or a post-processing apparatus. Examples of the discharge unit include bin trays including multiple discharge trays stacked. It is to be noted that, in FIG. 1, reference characters Fa and 70 represent an attachment assist device and a shaft with which the side frame F is hinged to the main unit of the printer 500.

Next, operations performed in single-sided printing are described below with reference to FIGS. 1 and 2.

The exposure unit 80 directs the laser beam 8Y emitted from the semiconductor laser source (not shown) according to image data of yellow onto the surface of the photoconductor 2Y uniformly charged by the charging roller 4*a*Y, thus forming an electrostatic latent image on the photoconductor 2Y. The development roller 5*a*Y develops the latent image with yellow toner to form a visible yellow toner image. The primary-transfer roller 7Y primarily transfers the yellow toner image onto the surface of the intermediate transfer belt 6*a* rotating in synchronization with the photoconductor 2Y. The above-described latent image formation, image development, and primary transfer of the image are also performed on the photoconductors 2C, 2M, and 2BK sequentially.

Accordingly, the yellow, cyan, magenta, and black toner images are superimposed one on another on the intermediate transfer belt 6*a*, forming a four-color toner image, and the intermediate transfer belt 6*a* transports the four-color image in the direction (counterclockwise) indicated by the arrow shown in FIG. 1. Meanwhile, the cleaning unit 3 removes residual toner, paper dust, and the like, from the surface of the photoconductor 2 having passed the position at which the primary-transfer roller 7 faces the photoconductor 2 via the intermediate transfer belt 6*a*.

The four-color toner image formed on the intermediate transfer belt 6*a* is transferred by the secondary-transfer roller 14*a* onto the sheet S transported in synchronization with the intermediate transfer belt 6*a*. The belt cleaning unit 6*h* cleans the surface of the intermediate transfer belt 6*a* in preparation for subsequent image formation and image transfer.

The sheet S is transported through a post-transfer path P2 to the fixing device 15, which fixes the toner image on the sheet S, and the discharge rollers 62 discharge the sheet S onto the discharge tray 60 with the image surface faced down.

Next, operations performed in duplex printing are described below with reference to FIGS. 1 and 2.

After a first toner image is transferred onto the first surface of the sheet S in the above-described transfer process, the sheet S passes through the fixing device 15 and is guided to the pair of rollers 17 by the switchable guide 63. The sheet S is transported through the reverse path P4, guided by the third guide G3 disposed downstream the pair of rollers 17 in the sheet conveyance direction, to the position above the second switchable guide G2 at the position shown in FIG. 1 and further transported to the switchback path P5 by the pair of reverse rollers 18. At that time, the reverse roller 18*a* rotates clockwise in FIG. 1. A pair of rollers 19 rotatable in both normal and reverse directions is provided in the switchback path P5. The pair of rollers 19 rotates in the normal direction until the sheet S fully enters in the switchback path P5 and then rotates in reverse, thus reversing the sheet S. When the pair of rollers 19 and the pair of reverse rollers 18 rotate in reverse, the second switchable guide G2 pivots counterclockwise from the position shown in FIG. 1. With an end of the sheet S that is on the trailing side before the sheet S enters the switchback path now forming a leading end, the sheet S is transported through the resupply path P6 by the rollers 15*c*, 20, 14*c*, and 21 to the feed path P1. Thus, the sheet S reaches the pair of registration rollers 13. Adjusting timing with image formation, the pair of registration rollers 13 transports the sheet P with its first surface carrying the first toner image to the secondary-transfer nipping area at which the secondary-transfer roller 14*a* faces the intermediate transfer belt 6*a*, and thus a second toner image formed on the intermediate transfer belt 6*a* is transferred onto a second surface (e.g., back side) of the sheet S.

When the sheet S reaches a predetermined position, formation of respective single-color toner images constituting the second toner image transferred onto the second surface of the sheet S are sequentially started. The second four-color toner image is formed in image forming processes similar to those in single-sided printing and transferred onto the intermediate transfer belt 6*a*. It is to be noted that the sheet S is turned upside down at that time, and accordingly emission of laser beams 8 from the exposure unit 80 is controlled so that the latent images are formed from the opposite side in the sheet conveyance direction relative to those of the first toner image.

The fixing device 15 fixes the second toner image on the sheet S, and the discharge rollers 62 discharge the sheet S carrying the images on both sides thereof onto the discharge tray 60.

It is to be noted that, in the printer 500, sheet conveyance is controlled so that multiple sheets S can be simultaneously transported through the sheet conveyance paths to reduce time required for duplex printing. Additionally, a controller, not shown, of the printer 500 controls timings at which images are formed on both sides of the sheet S.

In the printer 500, the polarity of toner images formed on the photoconductors 2 is negative, and the primary-transfer rollers 7 are charged with positive electrical charges to transfer the toner images from the respective photoconductors 2 onto the intermediate transfer belt 6*a*.

Similarly, the secondary-transfer roller 14*a* is charged with positively electric charges to transfer the toner image from the intermediate transfer belt 6*a* onto the sheet S.

It is to be noted that, although the description above concerns a configuration in which multicolor image formation is performed in both single-sided printing and duplex printing, the photoconductors 2Y, 2M, and 2C for yellow, magenta, and cyan, respectively, are not used in monochrome printing using only black toner. Therefore, the photoconductors 2Y, 2M, and 2C are not activated in monochrome printing using only black toner. Further, the printer 500 includes a disengagement mechanism to disengage the photoconductors 2Y, 2M, and 2C from the intermediate transfer belt 6*a*. More specifically, in the printer 500, an inner frame 6*f* supporting the roller 6*d* and the primary-transfer rollers 7 is pivotable around a frame shaft 6*g*. In monochrome printing, the inner frame 6*f* is pivoted away from the photoconductors 2Y, 2M, and 2C (in FIG. 1, clockwise) with only the photoconductor 2Bk in contact with the intermediate transfer belt 6*a*, and black image formation is performed in this state. Thus, operational lives of the image forming units 1Y, 1M, and 1C can be extended by disengaging the photoconductors 2Y, 2M, and 2C from the intermediate transfer belt 6*a* as well as inactivating the photoconductors 2Y, 2M, and 2C and the development devices 5Y, 5M, and 5C in monochrome printing.

An outer cover, not shown, of the printer 500 is opened and closed for maintenance such as replacement of components. The components (image forming components) of each image forming unit 1 shown in FIG. 2 are held in a common unit casing, that is, the image forming unit 1 is configured as a removably insertable (retractable) process cartridge into the printer 500. Thus, the components of the image forming unit 1 can be replaced at once by replacing the process cartridge, and thus handling of the components in maintenance can be easier.

When each image forming unit 1 is configured as a process cartridge, insertion and removal of the process cartridge can be facilitate by providing a guide or handle in the process cartridge. Further, providing the process cartridge with a storage device, such as an integrated circuit (IC) tag, storing characteristics and operational conditions of the process cartridge can facilitate management of the process cartridge.

Additionally, when the intermediate transfer unit 6 is removable form the printer 500 with the intermediate transfer belt 6*a* disengaged from the photoconductors 2, handling of the intermediate transfer unit 6 in maintenance work can be easier.

Figure 3:
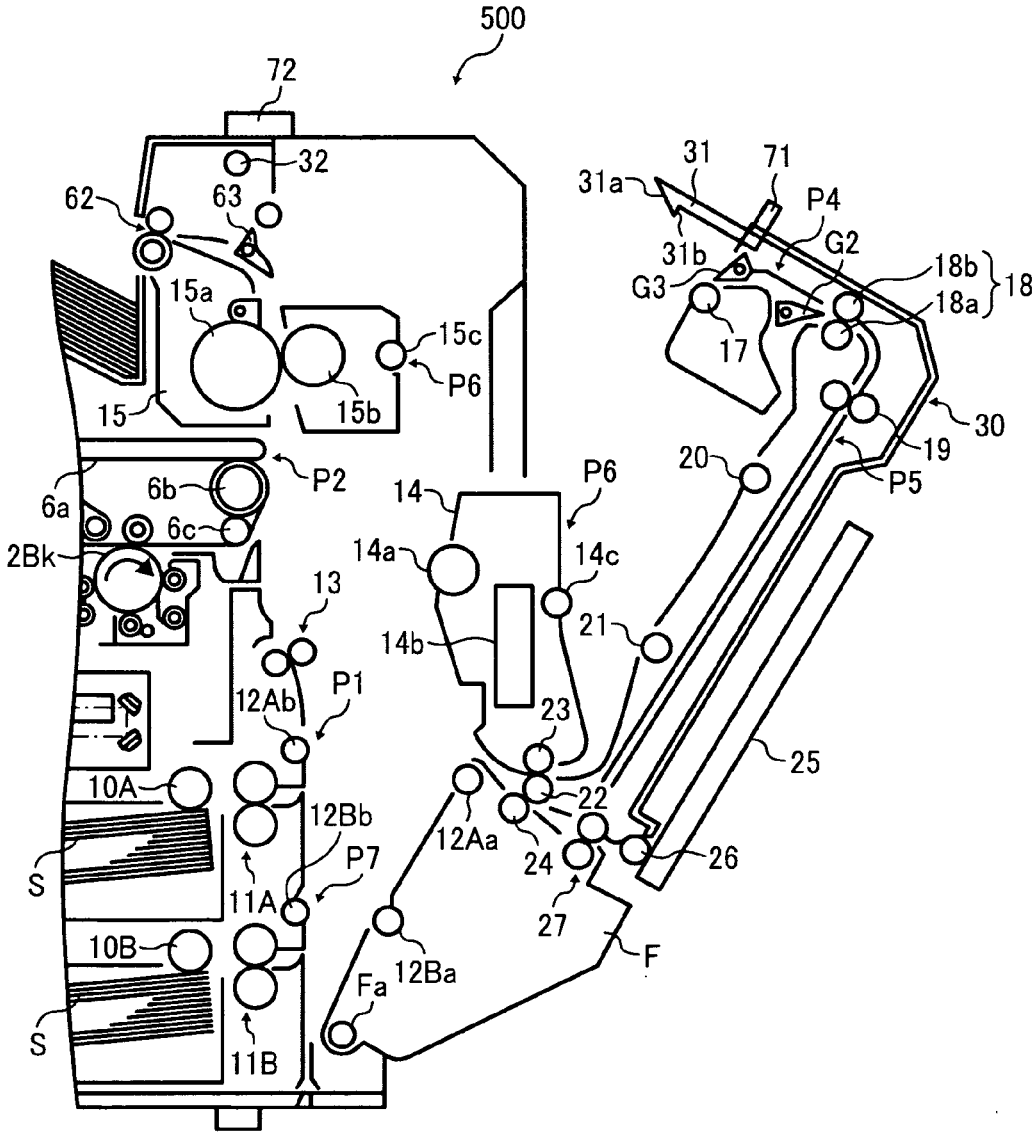
FIG. 3 is a schematic view illustrating a configuration of a side frame and nearby components of the printer.

FIG. 3 illustrates a configuration around the side frame F when the side frame F is opened with respect to the printer 500.

It is to be noted that, in FIG. 3, reference characters 12Aa and 12Ab respectively represent the rollers 12A on the side of the main unit (hereinafter "main unit side") and the side of the side frame F (hereinafter "side-frame side"), and reference characters 12Ba and 12Bb respectively represent the rollers 12B on the main unit side and the side-frame side.

Referring to FIG. 3, the side frame F is pivotable around the shaft Fa with respect to the printer 500, and the duplex unit 30 and the secondary-transfer unit 14 are housed in the side frame F. When the side frame F is pivoted clockwise from the position shown in FIG. 1, the secondary-transfer unit 14 and an interior of the duplex unit 30 are exposed as shown in FIG. 3. The side frame F further includes a stopper 31 and, when users operate a lock lever (not shown), the stopper 31 is disengaged from an engagement member 32 provided in the main unit of the printer 500, thus pivoting the side frame F. With this configuration, the multiple sheet paths, that is, the feed path P1, the post-transfer path P2, and the resupply path P6, can be exposed by pivoting the side frame F, thus facilitating removal of sheets from these sheet paths when sheets jammed therein.

On an upper face of the side frame F is provided an engagement protrusion 71 that is an engaged member. When the side frame F is closed to install the secondary-transfer unit 14 and the duplex unit 30 to the printer 500, the engagement protrusion 71 engages with an engaging portion, not shown, of a second attachment assist device 72 provided on a main unit of the printer 500. Alternatively, the engagement protrusion 71 and the engagement portion of the second attachment assist device 72 may be an engaging member and an engaged portion, respectively. When the engagement protrusion 71 engages with the engagement portion of the second attachment assist device 72, the second attachment assist device 72 draws the side frame F toward the main unit of the printer 500. As the second attachment assist device 72 draws the side frame F, a guide portion 31*a* of the stopper 31 contacts the engagement member 32 and the drawing force of the second attachment assist device 72 causes the stopper to pivot and move over the engagement member 32. Thus, the side frame F is closed with respect to the main unit of the printer 500, and the secondary-transfer unit 14 and the duplex unit 30 are attached to the attachment positions.

The secondary-transfer unit 14 is disposed between the post-transfer path P2 and the switchback path P5 and rotatable around the roller 23. When the side frame F is opened with respect to the main unit of the printer 500 as shown in FIG. 3; the secondary-transfer roller 14*a* is disengaged from the intermediate transfer belt 6*a*. The secondary transfer unit 14 is pivotable so as to disengage the roller 14*c* from the roller 21. The secondary transfer unit 14 has the power source 14*b* at the interior and the secondary-transfer roller 14*a* and the rollers 14*c* and 23 at the exterior to transport the sheet S.

The fixing device 15 includes the roller 15*c* for transporting the sheet S and a guide surface for guiding the sheet S, and a right side surface of the fixing device 15 in FIG. 3 forms the resupply path P6. The fixing device 15 is supported by a housing of the printer 500 so that the fixing device 15 can be pulled out to the right in the state shown in FIG. 3. This configuration facilitates removal of sheets when a sheet jam has occurred inside the fixing device 15.

The roller 15*c* for transporting the sheet S is urged toward the roller 20 by a spring, not shown, and the roller 14*c* is urged toward the roller 21 by a spring, not shown. Additionally, the rollers 12Ab and 12Bb on the main unit side are urged to the rollers 12Aa and 12Ba on the side-frame side by springs (not shown), respectively.

With this configuration, the side frame F at the position shown in FIG. 1 (e.g., closed position) is urged in a direction in which the side frame F pivots down in FIG. 1 and thus opens with respect to the main unit of the printer 500 by the rollers 14*c*, 15*c*, 12Ab, and 12Bb biased by the respective springs (not shown). Consequently, a stopper surface 31*b* of the stopper 31 is in contact with the engagement member 32, thus setting the side frame F in position. In other words, the rollers 14*c*, 15*c*, 12Ab, and 12Bb on the main unit side together form a bias unit when the side frame F is set in position relative to the main unit of the printer 500 with the stopper 31 on the side-frame side and the engagement member 32 on the main unit side.

Next, a configuration of the sheet tray 9C among the sheet trays 9A, 9B, 9C, and 9D is described below with reference to FIG. 4. It is to be noted that the sheet trays 9A, 9B, and 9D have configurations similar to that of the sheet tray 9C, and thus descriptions thereof are omitted.

Figure 4:
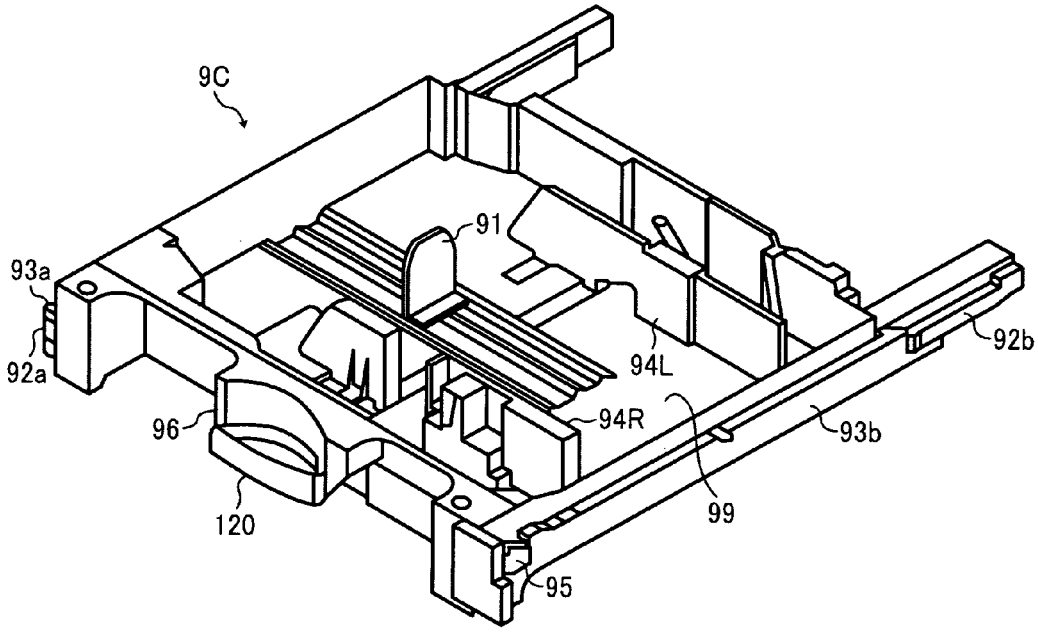
FIG. 4 is a perspective view illustrating a configuration of a sheet tray of the printer.

FIG. 4 is a perspective view illustrating the sheet tray 9C.

As shown in FIG. 4, projections 92*a* and 92*b* are respectively provided on both sides of the sheet tray 9C. The sheet feeder 50 (shown in FIG. 1) serving as a main device includes guide rails 93*a* and 93*b* that support the projections 92*a* and 92*b*, respectively. With the projections 92*a* and 92*b* supported by the guide rails 93*a* and 93*b*, respectively, the sheet tray 9C can be pulled out from the sheet feeder 50 to the front side (front side of the printer 500) in a direction (e.g., sheet width direction) perpendicular to the sheet conveyance direction and slidably inserted in the sheet feeder 50. The sheet trays 9A, 9B, and 9D having the similar configuration to the sheet tray 9C are configured as detachably insertable or retractable units to the main unit of the printer 500.

The sheet tray 9C includes a bottom plate 99 swingable upward to lift the sheets S contained in the sheet tray 9C, an end fence 91 to guide trailing end portions of the sheets S, a pair of side guides 94L and 94R to guide the sheets S on both sides in the sheet width direction.

The sheet tray 9C further includes a handle supporter 96 disposed on a middle portion on the front side of the sheet tray 9C, and a handle 120 is attached to the handle supporter 96. The handle 120 supported by the handle supporter 96 is movable in a direction of insertion and removal of the sheet tray 9C, whereas the handle supporter 96 limits movement of the handle 120 in the width direction as well as an upward direction.

When the sheet tray 9C is pulled and attached to the printer 500, the sheet tray 9C is drawn with the attachment assist device 70 described below in a direction in which the sheet feeder 50 is attached to the printer 50, and pressed against a contact portion 750. Thus, the sheet tray 9C is positioned with respect to the insertion and removal direction and held at the attachment state.

When the handle 120 is pulled out in the removal direction from the attachment state at which the sheet tray 9C is attached to the printer 500, the sheet tray 9C is moved in the removal direction to be pulled out from the printer 500.

Figure 5:
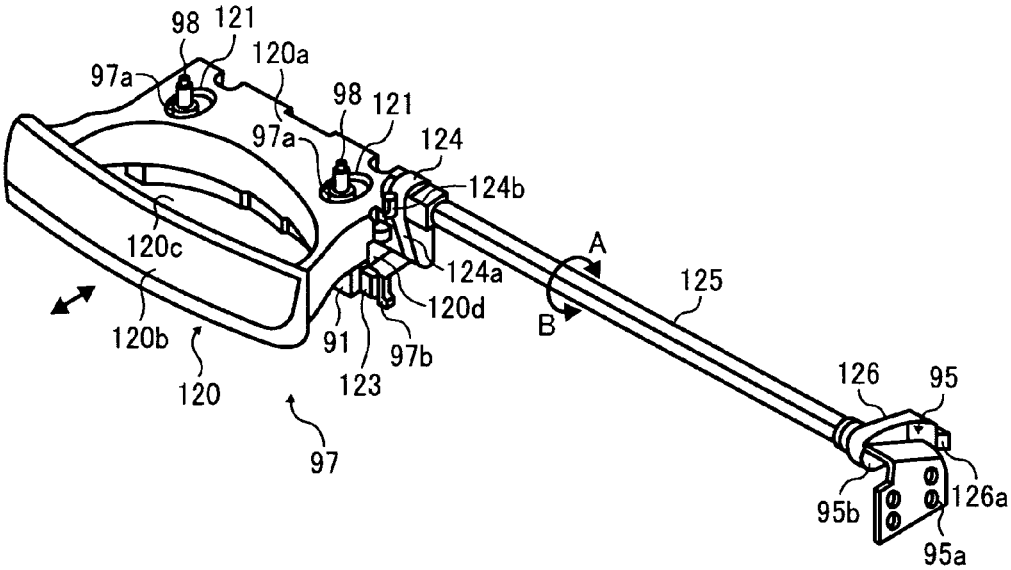
FIG. 5 is a perspective view illustrating a configuration of a handle and nearby components of the sheet tray.

As illustrated in FIG. 5, the handle 120 includes a base portion 120*a*, a grip portion 120*b*, and a space 120*c* between the base portion 120*a* and the grip portion 120*b*. In FIG. 5, a cover 97 is disposed below the base portion 120*a* of the handle 120, and two bosses 97*a* are disposed on an upper face of the cover 97. Each of the bosses 97*a* includes a through hole vertically penetrating through each boss 97*a*. The base portion 120*a* of the handle 120 includes two elongate holes 121 into which the corresponding bosses 97*a* of the cover 97 are inserted. The elongate holes 121 of the handle 120 are slightly greater in the short direction than the outer diameter of the bosses 97*a* so as to be slidable without rattling. The elongate holes 121 of the handle 120 are also greater in the long direction by a certain length than the outer diameter of the bosses 97*a*. It is to be noted that FIG. 5 illustrates a state of the handle 120 and other components when the sheet tray 9C is set in the printer 500.

The screws 98 are inserted to the corresponding through holes of the bosses 97*a* from below. Thus, the cover 97 is attached with the screws 98 to the handle supporter 96 disposed above the base portion 120*a* of the handle 120 so that the handle 120 is mounted and held in the main body of the sheet tray 9C with the base portion 120*a* of the handle 120 sandwiched from above and below by the handle supporter 96 and the cover 97.

Such a configuration allows the handle 120 to move only in the insertion and pull-out directions of the sheet tray 9C indicated by a double arrow illustrated in FIG. 5. Further, the handle 120 is movable only within a range defined by the elongate holes 121 and the bosses 97*a* of the cover 97.

A shaft 125 is held on the front face of the sheet tray 9C so as to rotate around an axis line of the shaft 125. A lever 124 is fixed at an end portion of the shaft 125 close to the handle 120. A protruding portion 124*a* is provided at a side face of an end portion of the lever 124, and the protruding portion 124*a* is engaged with an engagement recessed portion 120*d* at a side face of the handle 120. A hook portion 124*b* is provided at a bottom side of the lever 124, and a tension spring 123 is extended between the hook portion 124*b* and a hook portion 97*b* of the cover 97. Elastic force of the tension spring 123 biases the lever 124 to rotate in the direction indicated by B in FIG. 5. A rear-side face of the protruding portion 124*a* is pressed against a rear-side face of the engagement recessed portion 120*d*, thus biasing the handle 120 in the insertion direction of the sheet tray 9C (i.e., toward a rear side of the image forming apparatus). When the handle 120 is pulled to a front side (i.e., in the pull-out direction of the sheet tray 9C), the rear-side face of the engagement recessed portion 120*d* presses the rear-side face of the protruding portion 124*a*, thus rotating the lever 124 (and the shaft 125) in the direction indicated by "A" in FIG. 5.

An outer lever 126 is fixed at an end portion of the shaft 125 opposite to the end portion thereof close to the handle 120. A stopper 126*a* protruding toward a side face of the sheet tray 9C is provided at a tip of the outer lever 126. The lever 124 and the outer lever 126 are attached to the respective end portions of the shaft 125 with the lever 124 and the outer lever 126 shifted from each other by, e.g., 90 degrees around the axis line. For example, when the lever 124 is oriented downward, the outer lever 126 is oriented toward the rear side of the sheet tray 9C. When the sheet tray 9C is attached in the printer 500, as illustrated in FIG. 5, the stopper 126*a* of the outer lever 126 contacts a counter face 95*a* vertically provided at an upper rear side of a counter member 95.

When the sheet tray 9C is attached to the printer 500, a biasing device, which is described below, presses the sheet tray 9C toward the front face of the printer 500, causing the stopper 126*a* of the outer lever 126 to contact the counter face 95*a* of the counter member 95. Thus, the sheet tray 9C is positioned with respect to the insertion and pull-out directions and held attached to the printer 500.

By pulling the handle 120 to the front side when the sheet tray 9C is attached in the printer 500, the lever 124, the shaft 125, and the outer lever 126 rotate in the direction "A" in FIG. 5, and the stopper 126*a* of the outer lever 126 rotates to move to a lower position. As a result, the stopper 126*a* detaches from the counter face 95*a*, causing the stopped state to be released. Thus, the sheet tray 9C is pulled toward the front side thereof. Further, when the handle 120 is pulled toward the front side, respective rear-side wall portions of the elongate holes 121 of the handle 120 contact and press the corresponding bosses 97*a* of the cover 97, causing the sheet tray 9C to be pulled out. As a result, the stopper 126*a* detaches from the counter face 95*a*, causing the stopped state to be released. Thus, the sheet tray 9C is pulled toward the front side thereof. Further, when the handle 120 is pulled toward the front side, respective rear-side wall portions of the elongate holes 121 of the handle 120 contact and press the corresponding bosses 97*a* of the cover 97, causing the sheet tray 9C to be pulled out.

Figure 6A:
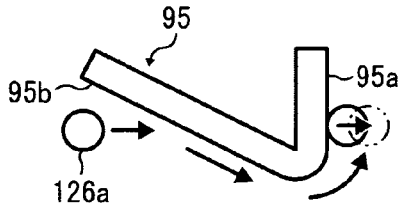
FIG. 6A is a schematic view illustrating relative positions of a stopper and a counter member before and after attachment of the sheet tray is completed.

By contrast, when the sheet tray 9C is attached to the printer 500, as illustrated in FIG. 6A, the stopper 126*a* of the outer lever 126 contacts a guide face 95*b* of the counter member 95. When the sheet tray 9C is further inserted, the stopper 126*a* is pressed against the guide face 95*b* to move downward along the guide face 95*b*. At this time, the outer lever 126 rotates in the direction "A" in FIG. 5. When the stopper 126*a* moves over a lower end portion (corner portion) of the guide face 95*b*, the outer lever 126 rotates in the direction "B" in FIG. 5 by a biasing force of the tension spring 123 and the stopper 126*a* moves to the counter face 95*a*, thus serving as a stopper mechanism.

Figure 7:
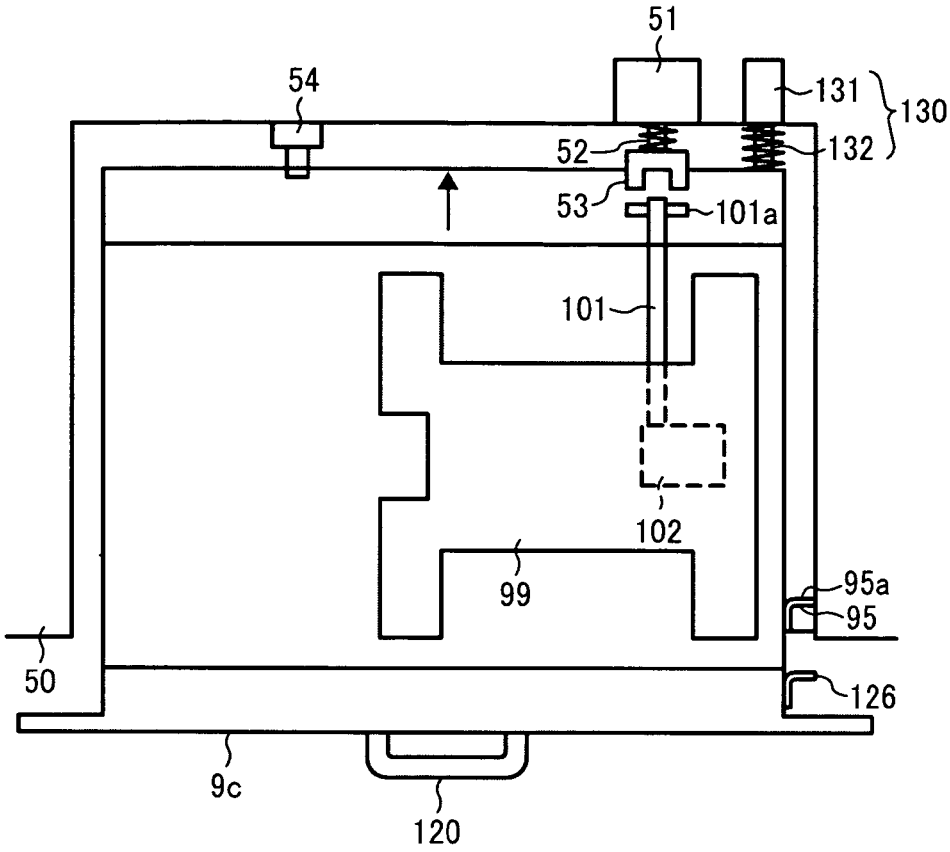
FIG. 7 is a plan view illustrating the sheet tray attached to a sheet feeder.
Figure 8:
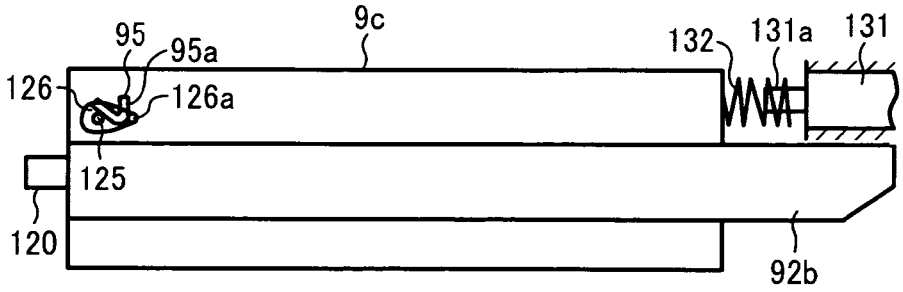
FIG. 8 is a side view illustrating relative positions of a biasing member and the counter member.

As illustrated in FIG. 7, the sheet feeder 50 of the printer 500 includes a elevation motor 51, a coupling member 53 that transmits a driving force from the elevation motor 51 to the sheet tray 9C and a bias spring 52 that is coiled to an output shaft 51*a* of the elevation motor 51 to bias the coupling member 53 toward the sheet tray 9C. During output of the elevation motor 51, the output shaft 51*a* can move back and force along the axis direction thereof, allowing the coupling member 53 attached to a tip of the output shaft 51*a* to move in the pull-out direction of the sheet tray 9C. A rotation shaft 101 is provided at the sheet tray 9C, and a coupling protrusion 101*a* that engages the coupling member 53 is provided at an rear-side (upper-side in FIG. 7) end portion of the rotation shaft 101. A press member 102 is fixed at a front-side (lower-side in FIG. 7) end portion of the rotation shaft 101, and pushes up a bottom plate 99 to press a sheet against a sheet feed roller 10C (see FIG. 1), allowing sheet feeding.

the sheet feeder 50 of the printer 500 includes an attachment detector 54 that detects attachment of the sheet tray 9C. The sheet feeder 50 further includes a biasing device 130 including a solenoid 131 and a compression spring 132. As illustrated in FIG. 8, the solenoid 131 includes an arm 131*a* movable in the insertion and pull-out direction of the sheet tray 9C, and the compression spring 132 is attached to a tip of the arm 131*a*. The biasing device 130 generates a biasing force to move the sheet tray 9C in the pull-out direction. In response to turning-on and -off, the solenoid 131 projects toward the sheet tray 9C and retreats from the sheet tray 9C. The bias direction of the biasing device 130 is a direction in which the stopper 126*a* is pressed against the counter face 95*a* of the counter member 95, i.e., the pull-out direction of the sheet tray 9C.

In attaching the sheet tray 9C to the printer 500, when the attachment detector 54 detects that the sheet tray 9C is attached to the printer 500, the solenoid 131 is turned on and the arm 131*a* advances toward the sheet tray 9C. The compression spring 132 contacts and presses a rear-side wall face of the sheet tray 9C to move the sheet tray 9C in the pull-out direction, i.e., push the sheet tray 9C toward the front face of the printer 500. Thus, when the sheet tray 9C is pushed by the solenoid 131, the stopper 126*a* at a position indicated by a dotted line in FIG. 6A is moved to contact the counter face 95*a*. Thus, the sheet tray 9C is positioned with respect of the insertion and pull-out directions thereof (e.g., an anterior-posterior direction of the printer, or a direction perpendicular to the direction in a sheet is fed from the sheet tray 9C. The biasing force of the solenoid 131 is set equal to or more than a force for moving the sheet tray 9C fully loaded with sheets to a stopper position at which the stopper 126*a* contacts the counter face 95*a*.

Alternatively, when the attachment detector 54 detects that the sheet tray 9C is pulled out from the printer 500, the solenoid 131 is turned off and the arm 131*a* retreats. The compression spring 132 also retreats to a retreat position at which the front tip of the compression spring 132 does not contact when the sheet tray 9C is attached. Thus, when the sheet tray 9C is pulled out from the printer 500, the compression spring 132 is located at the retreat position. Such a configuration can prevent the compression spring 132 from blocking insertion of the sheet tray 9C.

The solenoid 131 may have a capability of holding the arm 131*a*. In other words, even if the solenoid 131 is turned off after the arm 131*a* advances toward the sheet tray 9C, the arm 131*a* may be held in an advanced state with the solenoid 131. In such a case, when the sheet tray 9C is attached, the solenoid 131 may be turned off after the sheet tray 9C moves to the stopper position. In this regard, when the attachment detector 54 detects that the sheet tray 9C is pulled out from the printer 500, the solenoid 131 is turned on to retreat the arm 131*a* and then the solenoid 131 is turned off.

It is to be noted that the attachment detector 54 may be, for example, a mechanical detector, such as a push switch, an optical detector, such as a photosensor, or any other suitable type of detector. The biasing unit that moves the sheet tray 9C to the stopper position is not limited to the solenoid 131 but may be, for example, a motor. It is also to be noted that the attachment detector 54 and the solenoid 131 may be mounted on the sheet tray 9C instead of the printer 500 side. In such a configuration, power needs to be supplied to the attachment detector 54 and the solenoid 131 mounted on the sheet tray 9C.

The biasing device 130 that presses the stopper 126*a* against the counter face 95*a* may be formed of only an elastic member(s), such as a spring. Such a configuration can obviate the attachment detector 54, allowing cost reduction.

Operations of the stopper 126*a* of the outer lever 126 and the counter member 95 are described below.

As illustrated in FIG. 6A, when the stopper 126*a* of the outer lever 126 contacts the guide face 95*b* of the counter member 95, the outer lever 126 rotates and the stopper 126*a* is guided along the guide face 95*b*. When the stopper 126*a* moves over a top portion (corner portion) of the counter member 95, the outer lever 126 rotates in reverse and returns to the original height. If the sheet tray 9C is pushed rearward over a predetermined position, the solenoid 131 pushes the sheet tray 9C forward by the excess amount. The stopper 126*a* contacts the counter face 95*a* of the counter member 95, and thus the sheet tray 9C is positioned.

The positional relationship between the solenoid 131 and the counter member 95 is described below.

As illustrated in FIGS. 7 and 8, the compression spring 132 that transmits a biasing force of the solenoid 131 and the counter face 95*a* of the counter member 95 are disposed so that the compression spring 132 and the counter face 95*a* have substantially the same positions (see FIG. 7) with respect to a width direction of the printer 500 (e.g., a lateral direction in FIG. 7) and substantially the same heights with respect to a vertical direction of the printer 500 (see FIG. 8). In other words, a working point of the biasing force of the solenoid 131 and the counter face 95*a* of the counter member 95 have substantially the same positions on a surface of projection in the insertion and pull-out direction of the sheet tray 9C (e.g., the top and bottom direction in FIG. 7). It is to be noted that, a bracket, not illustrated, or any other suitable member may be attached to the sheet tray 9C to match the working point of the solenoid 131 with the counter face 95*a* of the counter member 95 on the surface of projection in the insertion and pull-out direction.

As described above, the compression spring 132 and the counter face 95*a* of the counter member 95 are disposed so that the working point of the biasing force of the solenoid 131 and the counter face 95*a* of the counter member 95 have substantially the same positions on the surface of projection in the insertion and pull-out direction (top and bottom direction in FIG. 7) of the sheet tray 9C. With such a configuration, the biasing force of the solenoid 131 is directed to the counter face 95*a*. Further, since the biasing direction of the solenoid 131 is the movable direction of the sheet tray 9C, the biasing force of the compression spring 132 causes little moment to change the orientation of the sheet tray 9C. Such a configuration can prevent the sheet tray 9C from skewing on attachment, thus allowing proper positioning.

Figure 6B:
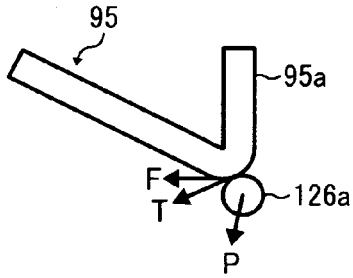
FIG. 6B is a schematic view illustrating relative positions of the stopper and the counter member in course of attachment of the sheet tray.

Due to assembling error or other factors, the solenoid 131 might not have a biasing force of moving the sheet tray 9C over the counter face 95*a*, causing failures. In such a case, if the sheet tray 9C is slowly attached to the printer 500, the force of a user pushing the sheet tray 9C in the insertion direction may balance the biasing force of the solenoid 131 and the compression spring 132 in the pull-out direction with the stopper 126*a* of the outer lever 126 stopped at the top portion of the counter member 95 as illustrated in FIG. 6B. In the state illustrated in FIG. 6B, if the attachment detector 54 detects attachment of the sheet tray 9C, the attachment detector 54 might not determine whether attachment of the sheet tray 9C has been completed. If operation of the printer is performed, the sheet tray 9C might exit from the printer 500.

It is to be noted that the biasing device 130 that positions the sheet tray 9C, i.e., pushes the stopper 126*a* against the counter face 95*a* may be formed of only an elastic member(s), such as spring, without using the solenoid 131. Such a configuration can obviate the solenoid 131 and/or the attachment detector 54, allowing cost reduction. However, such a configuration might not implement switching-on and -off or adjustment of the biasing force. In such a case, on attachment, the sheet tray 9C needs to be attached to the printer 500 against a biasing force of the elastic member, i.e., a force enough to push the sheet tray 9C fully loaded with sheets in the pull-out direction. Consequently, the biasing force for positioning the sheet tray 9C might become a resistance force on attachment of the sheet tray 9C, causing a reduction in operability of the user attaching the sheet tray 9C.

Hence, as illustrated in FIG. 1, the printer 500 includes the attachment assist device 70 to draw the sheet tray 9C to the attachment position to prevent a half-attached (incompletely-attached) state or a reduction in operability.

The attachment assist device 70 is described below. The following description is given of the attachment assist device 70 that draws the sheet tray 9C that is a sub unit detachably attached to the printer 500. It is to be noted that the second attachment assist device 72 that draws the side frame F, a sub unit openable and closable relative to the printer 500, has a configuration similar to the configuration of the attachment assist device 70.

Figure 9:
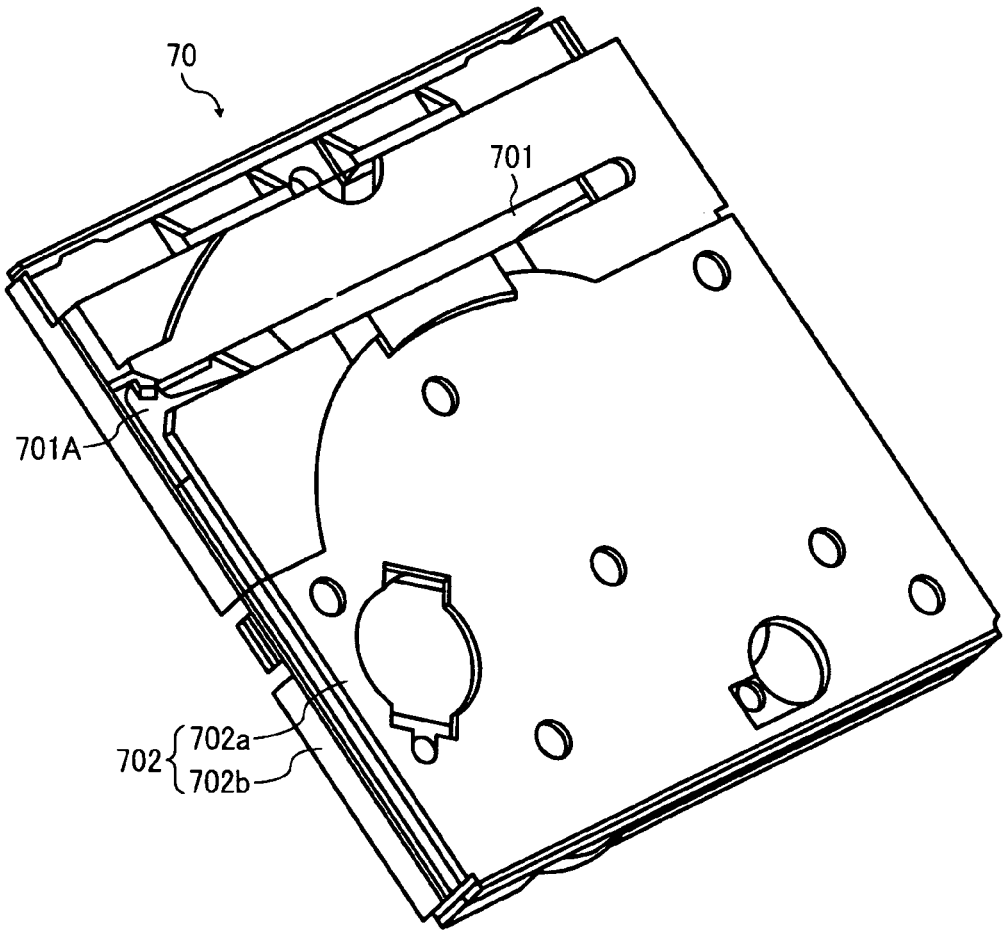
FIG. 9 is a perspective view illustrating an upper side of an attachment assist device according to an exemplary embodiment.
Figure 10:
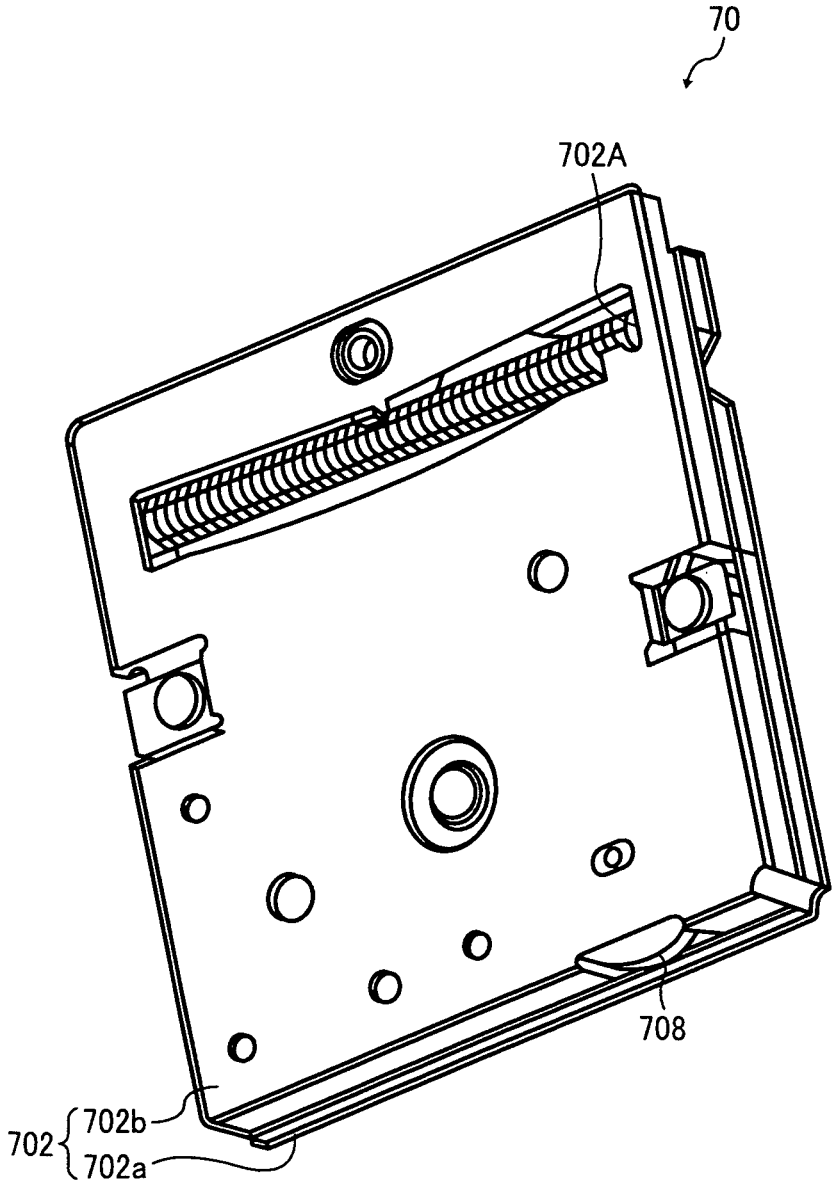
FIG. 10 is a perspective view illustrating a bottom side of the attachment assist device illustrated in FIG. 9.

As illustrated in FIGS. 9 and 10, the attachment assist device 70 includes a base 702, a guide slot 701, and a guide slot inlet 701A at the mouth of the guide slot 701. The base 702 is a housing of the attachment assist device 70 and includes an upper base member 702*a* and a lower base member 702*b*. The guide slot 701 guides an engagement protrusion 59 disposed at a lower outer face of the sheet tray 9C illustrated in FIG. 1. The engagement protrusion 59 is inserted into the guide slot 701 to engage the attachment assist device 70. The base 702 is mounted in the printer 500.

Figure 11:
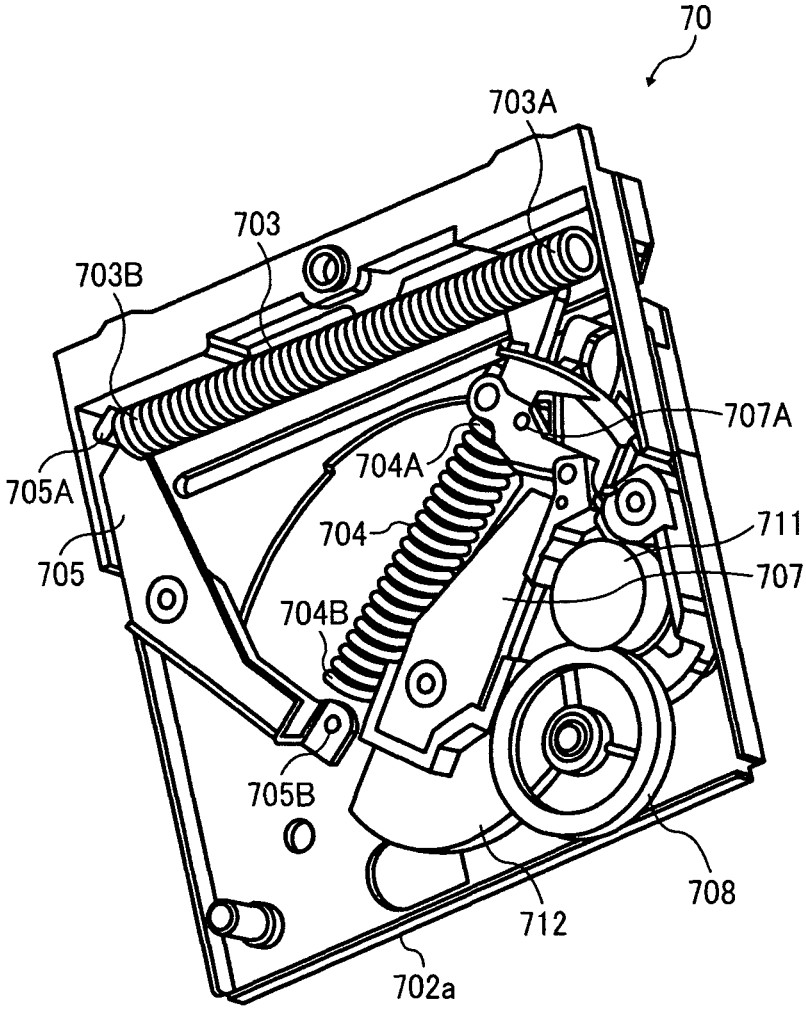
FIG. 11 is a perspective view illustrating the attachment assist device with the bottom side thereof open.
Figure 12:
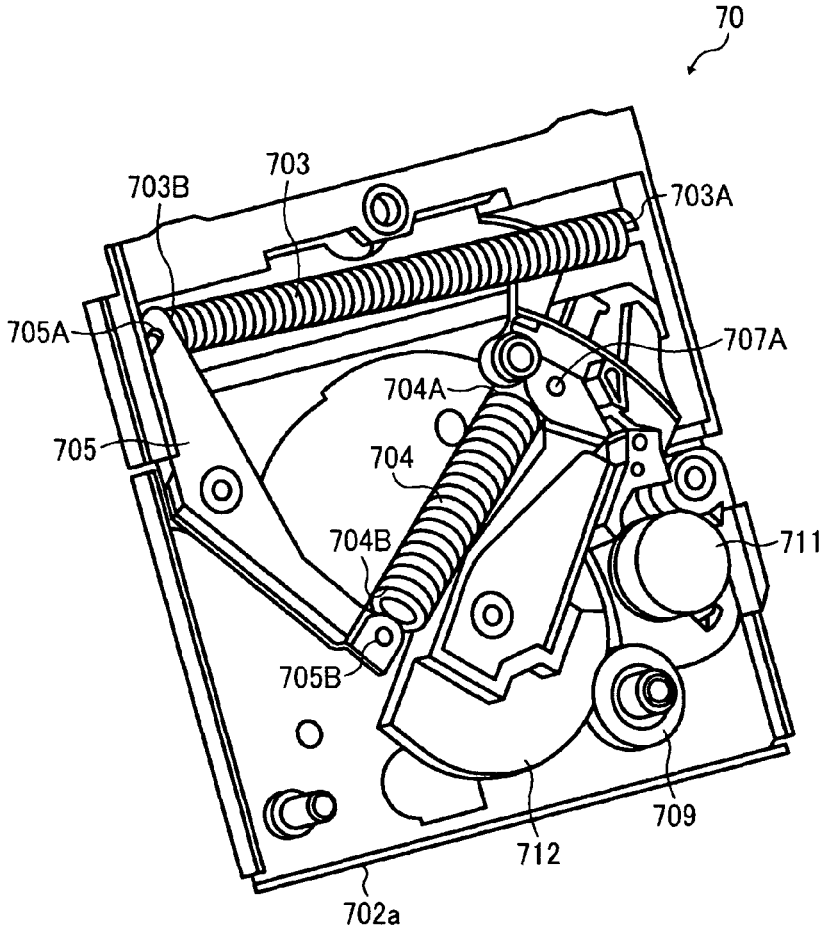
FIG. 12 is a perspective view illustrating the attachment assist device with the bottom side thereof open.

Next, an internal configuration of the attachment assist device 70 is described below. FIGS. 11 and 12 are views illustrating states of the attachment assist device 70 in which the lower base member 702*b* is removed. In FIG. 12, several components illustrated in FIG. 11 are deleted solely for clarity.

As illustrated in FIGS. 11 and 12, a first lever 707 and a first gear 712 rotate in unison with each other around respective rotation axes. An outer circumferential portion of the first gear 712 meshes with an outer circumferential portion of a second gear 709.

Figure 13:
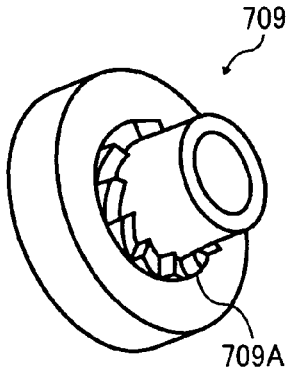
FIG. 13 is a perspective view illustrating a second gear of the attachment assist device.
Figure 14:
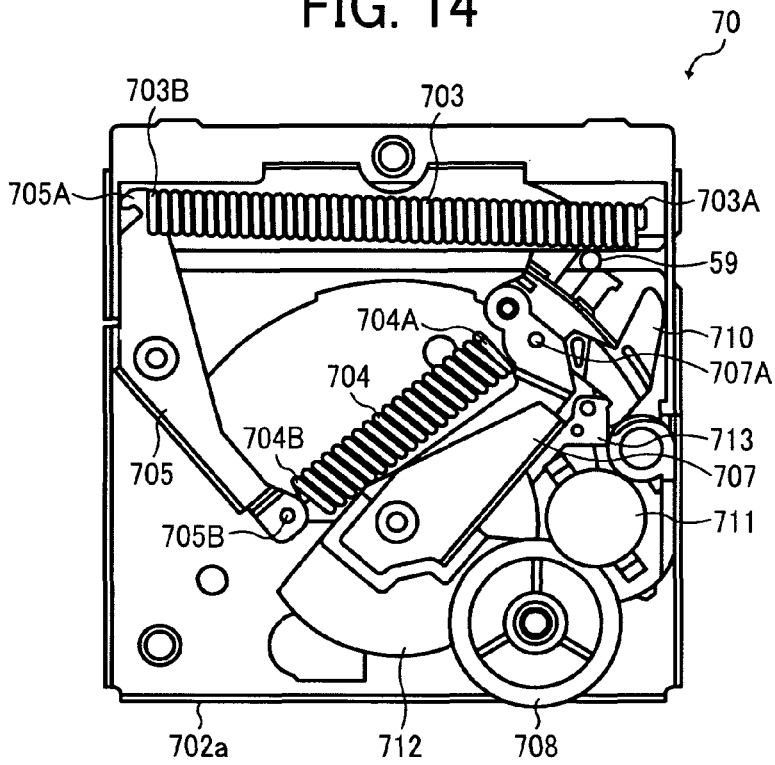
FIG. 14 is a plan view illustrating the attachment assist device.

As illustrated in FIG. 13, the second gear 709 includes a latch 709A at a central portion thereof, and the latch 709A is engaged with a latch, not illustrated, of a central portion of a third gear 708 in only one direction. Thus, rotation in only one direction is transmitted between the second gear 709 and the third gear 708, and the second gear 709 and the third gear 708 rotate in unison with each other. Only when the second gear 709 rotates in the same direction as a direction in which the second gear 709 rotates when the sheet tray 9C is drawn into the printer 500, rotation is transmitted between the second gear 709 and the third gear 708 via the latch 709A.

The attachment assist device 70 further includes a speed-dependent damper 711 that meshes with the third gear 708 at an outer circumferential portion thereof. When the rotational speed of the speed-dependent damper 711 is high, the speed-dependent damper 711 generates a great load (damping force). By contrast, when the rotational speed is low, the speed-dependent damper 711 generates a small load. The speed-dependent damper 711 transmits such load as a braking force to the third gear 708. When the sheet tray 9C is pulled from the printer 500, the latch 709A shuts off the transmission of rotation between the second gear 709 and the third gear 708. Accordingly, the load of the speed-dependent damper 711 is not transmitted from the third gear 708 to the second gear 709.

Figure 15:
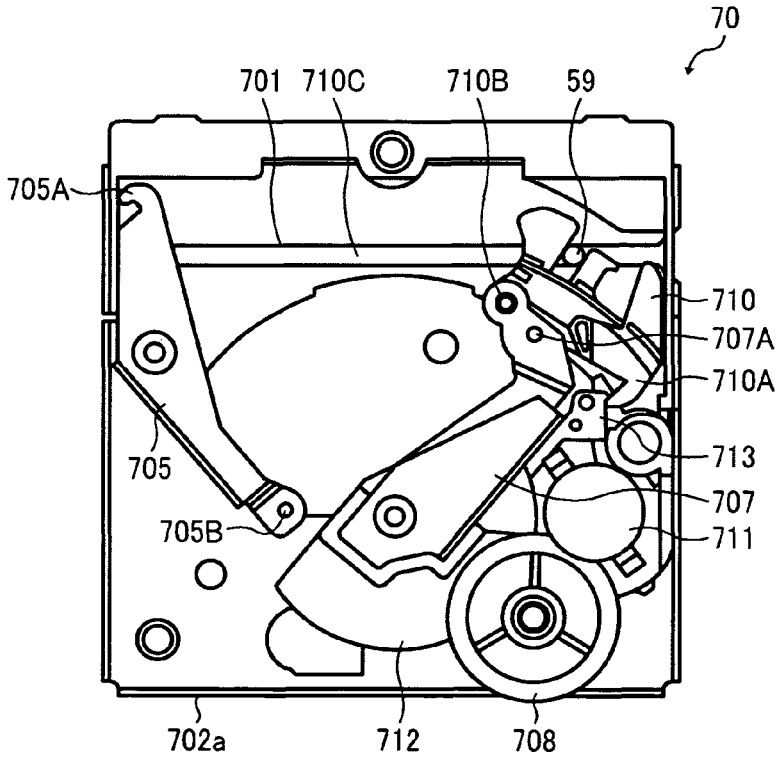
FIG. 15 is a plan view illustrating a state at which the attachment assist device starts to draw a sheet tray.

As illustrated in FIG. 15, the attachment assist device 70 includes a support point 710B disposed on the first lever 707 and a hook 710 that is freely rotatable relative to the first lever 707 around the support point 710B. The first lever 707 engages an end portion 704A of a first spring 704 at an engagement hole 707A and is biased by the first spring 704. An end portion 704B of the first spring 704 engages an engagement hole 705B of a second lever 705 rotatably configured. An end portion 703B of a second spring 703 engages an engagement portion 705A of an end portion of the second lever 705. An end portion 703A of the second spring 703 is engaged with an engagement portion 702A (see FIG. 10) of the lower base member 702*b*.

Figure 19:
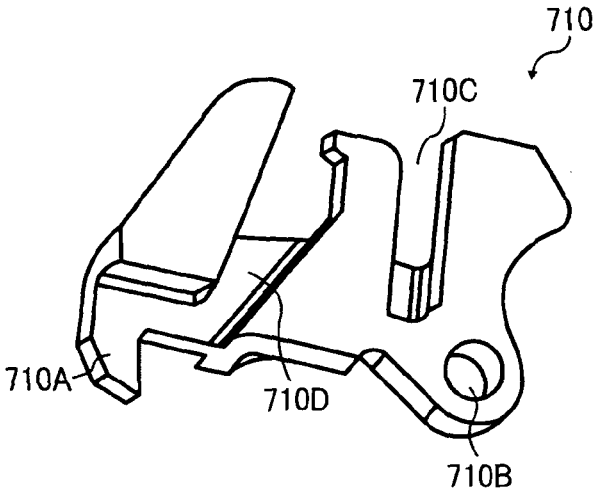
FIG. 19 is a perspective view illustrating a hook of the attachment assist device.

As illustrated in FIG. 19, the hook 710 is integrally provided with a first slot 710C, a second slot 710D, and a hook lock portion 710A. The first slot 710C is used in an ordinary drawing operation. The second slot 710D is used in a recovery operation performed if the drawing of the attachment assist device 70 is finished with the attachment assist device 70 not engaged with the engagement portion of the sheet tray 9C. The hook lock portion 710A engages a hook portion 714A of a damper holder 714 to limit movement of a hook 710 and thus rotation of the first lever 707.

Figure 16:
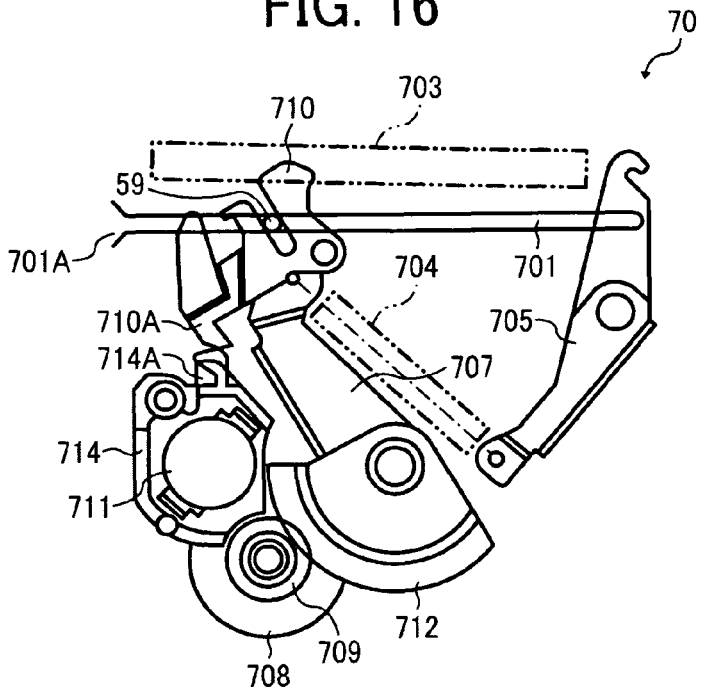
FIG. 16 is a plan view illustrating a state at which the attachment assist device starts to draw the sheet tray.

The engagement protrusion 59 disposed at a bottom face of the sheet tray 9C is inserted from the guide slot inlet 701A to the guide slot 701 by a force applied by a user to the sheet tray 9C to press the first slot 710C of the hook 710. As a result, the hook 710 engaged with the damper holder 713 rotates around the support point 710B, thus causing the hook 710 to be disengaged from the damper holder 713. When the hook 710 is disengaged from the damper holder 713, as illustrated in FIG. 16, the hook 710 having the support point 710B on the first lever 707 starts to draw the engagement protrusion 59 by the biasing force of the first spring 704. The direction in which the hook 710 draws the engagement protrusion 59 is the rightward direction in FIGS. 16, 17, and 18. When the hook 710 further draws the engagement protrusion 59, the engagement protrusion 59 moves via a position illustrated in FIG. 17 to a position illustrated in FIG. 18 at which the sheet tray 9C is fully drawn to the main unit of the printer 500.

A drawing force with which the first lever 707 biased by the first spring 704 draws the engagement protrusion 59 is balanced with the second spring 703 having a biasing force differing from the first spring 704. In other words, the biasing forces of both the first spring 704 and the second spring 703 are applied to the second lever 705, and the first spring 704 is stretched until the first lever 707 moves from the drawing start position illustrated in FIG. 16 to the halfway-drawn position illustrated in FIG. 17. Accordingly, the moment with which the second lever 705 is rotated counterclockwise in FIGS. 16 to 18 by the second spring 703 is smaller than the moment with which the second lever 705 is rotated clockwise in FIGS. 16 to 18 by the first spring 704, thus preventing movement of the second lever 705.

Figure 17:
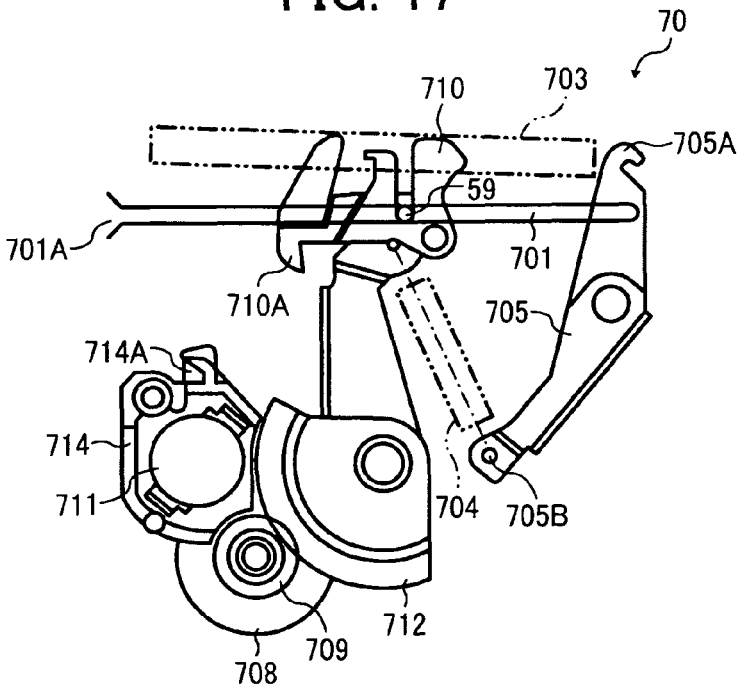
FIG. 17 is a plan view illustrating a state at which the attachment assist device is drawing the sheet tray.
Figure 18:
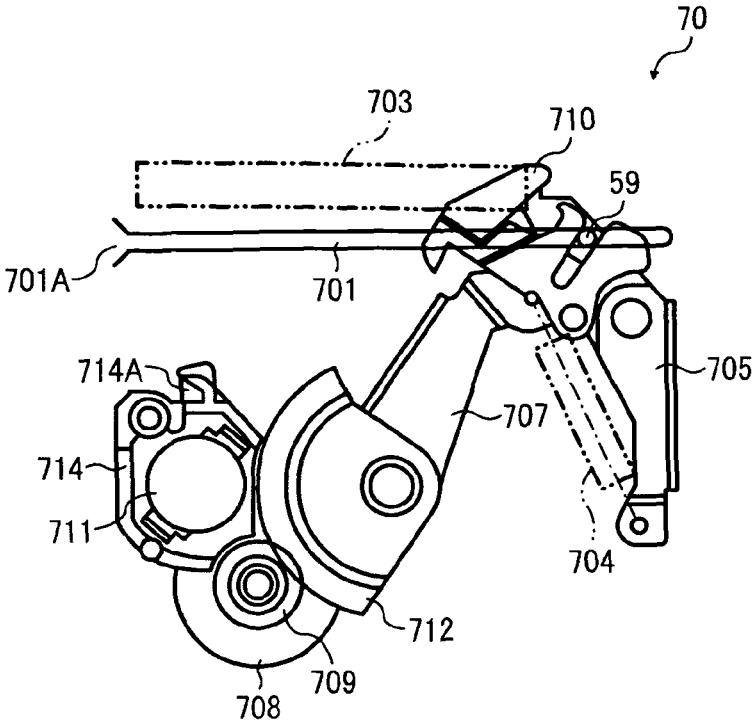
FIG. 18 is a plan view illustrating a state at which drawing with the attachment assist device is completed.

When the first lever 707 moves over the halfway-drawn position illustrated in FIG. 17, the first spring 704 contracts. As a result, the moment with which the second lever 705 is rotated counterclockwise in FIGS. 16 to 18 by the second spring 703 is greater than the moment with which the second lever 705 is rotated clockwise in FIGS. 16 to 18 by the first spring 704. Accordingly, the second lever 705 rotates clockwise to move to the position illustrated in FIG. 18, and the first lever 707 is rotated by the second lever 705 via the first spring 704. With such a configuration, the drawing force of the engagement protrusion 59 is maintained at a strong state, allowing proper drawing of the sheet tray 9C and downsizing of the attachment assist device 70. Specifically, in the attachment assist device 70, two springs, i.e., the first spring 704 and the second spring 703, are employed instead of a single spring. The directions of the biasing forces of the first spring 704 and the second spring 703 are adjusted with the first lever 707 and the second lever 705 so that the biasing forces are serially joined to create the drawing force for drawing the sheet tray 9C to the main unit of the printer 500. Such a configuration provides a reduction in the space occupied by the second spring 703, thus allowing downsizing of the attachment assist device 70.

Figure 22:
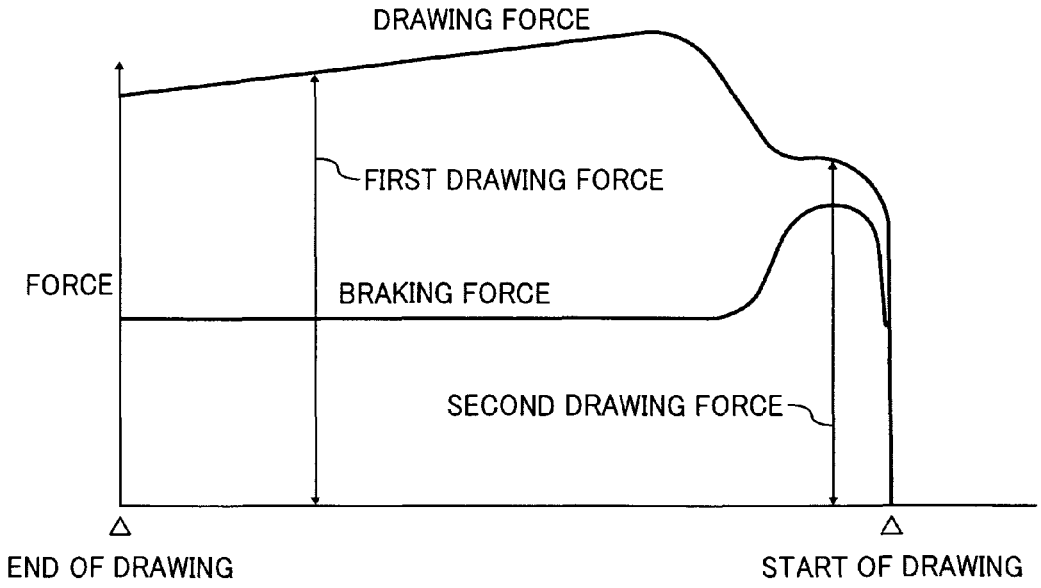
FIG. 22 is a chart illustrating a relation between a drawing force and a braking force.

For the drawing force of the engagement protrusion 59, as illustrated in FIG. 22, the biasing forces of the first spring 704 and the second spring 703 and the positions of the engagement portion 704A of the first lever 707, the engagement portion 705A and the engagement hole 705B of the second lever 705, and the engagement portion 702A of the base 702 are adjusted so that a second drawing force after the start of drawing is smaller than a first drawing force during drawing operation or after drawing operation is completed. Thus, when the drawing force after the start of drawing is set small, the load (damping force) generated by the speed-dependent damper 711 in drawing the engagement protrusion 59 works as a great braking force against the setting direction of the sheet tray 9C.

Figure 20:
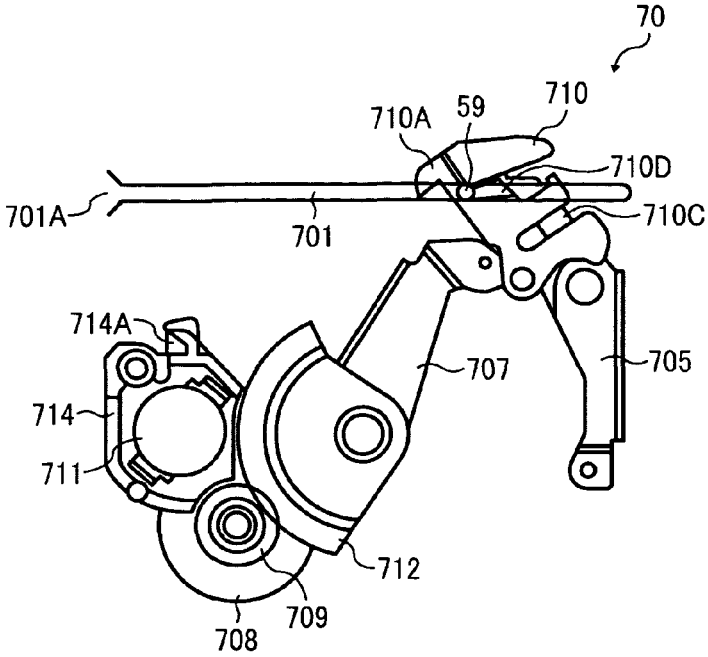
FIG. 20 is a plan view illustrating a state at which a recovery operation of the attachment assist device is performed.
Figure 21:
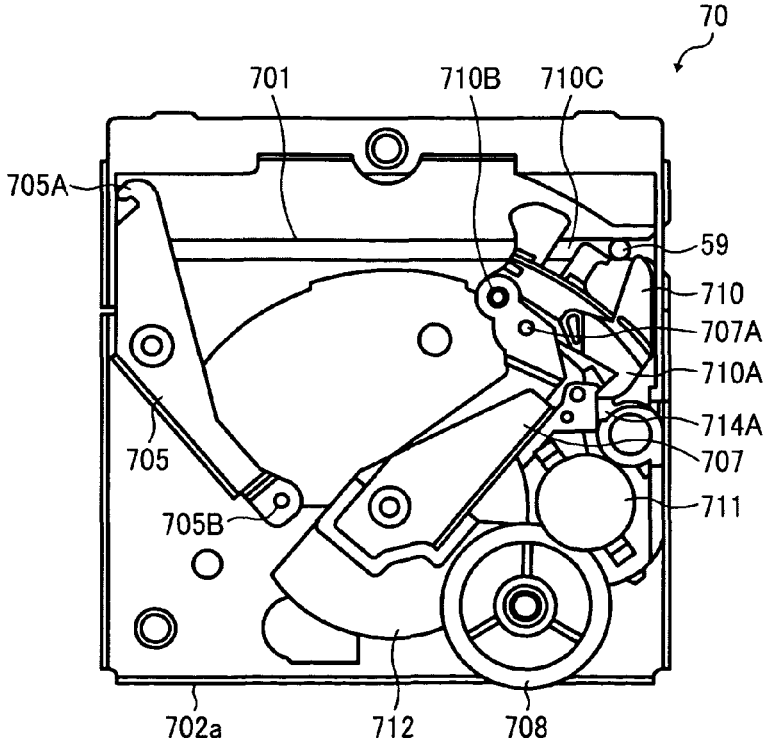
FIG. 21 is a plan view illustrating a state at which a recovery operation of the attachment assist device is performed.

As illustrated in FIG. 20, when the engagement protrusion 59 is not engaged with the hook 710 with the attachment assist device 70 drawn, the first lever 707 may be located at a drawing end position at which drawing operation is finished. In such a case, if the engagement protrusion 59 of the sheet tray 9C is inserted to the attachment assist device 70 in the same way as the ordinary operation, the engagement protrusion 59 causes the hook 710 to rotate clockwise in FIG. 20 and thus is forcefully inserted to the second slot 710D of the hook 710. At this time, the engagement protrusion 59 is engaged with the second slot 710D of the hook 710. At this state, when the sheet tray 9C is pulled out, as illustrated in FIG. 21, the hook lock portion 710A engages the hook portion 714A of the damper holder 714 to limit the rotation of the first lever 707. Although the amount of engagement between the hook portion 714A and the hook lock portion 710A is smaller than the amount of engagement between the engagement protrusion 59 and the first slot 710C of the hook 710, the engaging portion between the hook portion 714A and the hook lock portion 710A has an engagement force (locking force) enough to limit the rotation of the first lever 707.

In the present exemplary embodiment, tension springs, such as the first spring 704 and the second spring 703, are employed as biasing members. It is to be noted that the biasing members may be, for example, compression springs, leaf springs, or elastic members such as rubber or resin.

In the above-described configuration, the attachment assist device 70 draws the sheet tray 9C to the main unit of the printer 500. However, it is to be noted that the target to be drawn with the attachment assist device 70 is not limited to the sheet tray 9C. For example, when the process cartridge is employed in the printer 500, with an outer cover of the main unit opened, the process cartridge is pulled toward the front side and removed from the main unit of the printer 500. Then, a new process cartridge is slid from the front side to the rear side and attached to the main unit of the printer 500. The attachment assist device 70 may be used for the attachment of the process cartridge to the main unit. Further, when the toner bottles 40Y to 40Bk are slid to the main unit of the printer 500 for replacement, the attachment assist device may be used for the attachment of the toner bottles 40Y to 40Bk to the main unit.

Furthermore, as described above, the side frame F, an openably closable unit, is drawn with the second attachment assist device 72. When the side frame F is drawn to the attachment position, a release unit releases the drawing force by which the second attachment assist device 72 draws the side frame F in the attachment direction. Thus, the side frame F is moved in the open direction by biasing forces of bias members that bias rollers of the duplex unit 30 and so on. As a result, the stopper face 31*b* of the stopper 31 contacts the engagement member 32, allowing the side frame F to be positioned. Thus, by adjusting the closing of the side frame F, a nipping pressure at which the pair of rollers contacts with each other is maintained at a proper level, allowing excellent transport performance.

The speed-dependent damper 711 is provided as a rotary damper that increases and decreases the load for reducing the movement speed of the sheet tray 9C or the side frame F in response to the drawn speed and size of the sheet tray 9C or the side frame F. Thus, when the sliding resistance of the sheet tray 9C or the side frame F is low and the movement speed thereof is high, the speed-dependent damper 711 generates a great load, allowing a great damping force to act against the movement of the sheet tray 9C or the side frame F. Such a configuration can prevent the sheet tray 9C or the side frame F from being attached to the attachment position. By contrast, when the sliding resistance of the sheet tray 9C or the side frame F is high and the movement speed thereof is low, the speed-dependent damper 711 generates a small load, preventing deficient drawing of the sheet tray 9C or the side frame F.

The speed-dependent damper 711 may be configured so as not to apply the load to the sheet tray 9C or the side frame F in moving the sheet tray 9C or the side frame F in the removal or open direction. Such a configuration allows a user to smoothly pull the sheet tray 9C or open the side frame F, improving operability.

The springs are employed as the bias members, obtaining the drawing force with an inexpensive configuration.

Using the attachment assist device 70 according to the present exemplary embodiment to draw the sheet tray 9C enhances operability of the sheet tray 9C in attachment and allows the sheet tray 9C to be properly positioned with respect to the pull-out direction.

Using the attachment assist device according to the present exemplary embodiment to draw the side frame F supporting the duplex unit 30 enhances operability of the duplex unit 30 in attachment and allows the duplex unit 30 to be properly positioned with respect to the open direction.

As described above, the attachment assist device 70 according to the present exemplary embodiment includes the first spring 704, the second spring 703, the first lever 707, and the second lever 705. The first spring 704 and the second spring 703 create biasing forces having different biasing directions. The first spring 704 and the second spring 703 are engaged with the first lever 707 and the second lever 705. The first lever 707 and the second lever 705 are rotatable around the support points and serially connect the first spring 704 and the second spring 703 to convert the biasing forces of the first spring 704 and the second spring 703 to a drawing force.

As described above, the first spring 704 and the second spring 703 having different biasing forces are serially connected via the first lever 707 and the second lever 705, both of which are rotatable, to create a drawing force. Such a configuration provides a reduced space occupied by the first spring 704 and the second spring 703.

Thus, drawing the sheet tray 9C to the attachment position can be properly performed without employing an upsized configuration.

Further, in the attachment assist device 70 according to the present exemplary embodiment, the engagement positions of the first spring 704 and the second spring 703 and the first lever 707 and the second lever 705 and the relative positions of the first spring 704 and the second spring 703 and the first lever 707 and the second lever 705 are defined to create one of the first drawing force for drawing the sheet tray 9C at relatively high speed and the second drawing force for drawing the sheet tray 9C at relatively low speed. The attachment assist device 70 further includes the speed-dependent damper 711 that is disposed to be able to transmit a drive force to the first lever 707 and the second lever 705. When the sheet tray 9C is drawn into the printer 500 by the biasing forces of the first spring 704 and the second spring 703 and the first lever 707 and the second lever 705 rotate, the speed-dependent damper 711 creates a load over an area from the drawing start position to the drawing end position in accordance with the rotation speed of the first lever 707 and the second lever 705 to limit rotation of the first lever 707 and the second lever 705.

When the sliding resistance of the sheet tray 9C or the side frame F is low and the movement speed of the sheet tray 9C drawn by the drawing force is high, the load of the speed-dependent damper 711 is great, thus significantly reducing the movement speed of the sheet tray 9C or the side frame F. Thus, such a configuration allows issuance of an alert to a user about the strength of handling the sheet tray 9C to prevent the sheet tray 9C or the side frame F from being forcefully attached to the attachment position. By contrast, when the sliding resistance of the sheet tray 9C or the side frame F is high and the movement speed of the sheet tray 9C drawn by the drawing force is low, the load of the speed-dependent damper 711 is small, thus preventing deficient drawing of the sheet tray 9C or the side frame F.

In the attachment assist device 70 according to the present exemplary embodiment, the engagement positions of the first spring 704 and the second spring 703 and the first lever 707 and the second lever 705 and the relative positions of the first spring 704 and the second spring 703 and the first lever 707 and the second lever 705 are defined so as to create the second drawing force at the drawing start position and the first drawing force, which is greater than the second drawing force, at an area other than the drawing start position.

Thus, by creating a small drawing force after the start of drawing, in drawing the engagement protrusion 59, the load (damping force) created by the speed-dependent damper 711 acts as a large braking force against the insertion direction (drawing direction) of the sheet tray 9C, thus significantly reducing the movement speed of the sheet tray 9C.

Further, in the attachment assist device 70 according to the present exemplary embodiment, the engagement positions of the first spring 704 and the second spring 703 and the first lever 707 and the second lever 705 and the relative positions of the first spring 704 and the second spring 703 and the first lever 707 and the second lever 705 are defined so that the drawing force smoothly shifts between the first drawing force and the second drawing force.

Such smooth shift of the drawing force between the first drawing force and the second drawing force allows the sheet tray 9C to be drawn to and pulled from the printer 500.

The attachment assist device 70 according to the present exemplary embodiment further includes the latch 709A that shuts off transmission of the load from the speed-dependent damper 711 to the first lever 707 and the second lever 705 when the sheet tray 9C is pulled toward the exterior of the printer 500 and the first lever 707 and the second lever 705 rotate.

Thus, when the sheet tray 9C or the side frame F is moved in the removal or open direction, the load of the speed-dependent damper 711 does not act on the sheet tray 9C or the side frame F. Such a configuration allows a user to smoothly remove or open the sheet tray 9C or the side frame F, enhancing operability.

In the attachment assist device 70 according to the present exemplary embodiment, the first lever 707 is provided with the hook 710. The hook 710 is integrally provided with the first slot 710C, the second slot 710D, and the hook lock portion 710A. The first slot 710C is engaged with the engagement protrusion 59 of the sheet tray 9C. The second slot 710D is engaged with the engagement protrusion 59 only when the sheet tray 9C is not at attachment completion position and the first lever 707 is at attachment completion position. The hook lock portion 710A limits rotation of the first lever 707 when the first lever 707 is at the drawing start position.

In an improper engagement state, after the attachment assist device 70 is drawn, the first lever 707 might be at drawing completion state with the engagement protrusion 59 not engaged with the hook 710. In such a case, if the engagement protrusion 59 of the sheet tray 9C is inserted to the attachment assist device 70 in the same way as the ordinary operation, the engagement protrusion 59 is forcefully inserted to the second slot 710D of the hook 710. At this state, if the sheet tray 9C is pulled, the hook lock portion 710A limits rotation of the first lever 707.

Thus, performing the ordinary operation to draw the sheet tray 9C allows recovery from improper engagement.

In the attachment assist device 70 according to the present exemplary embodiment, the magnitude of the biasing force is different between the first spring 704 and the second spring 703.

Accordingly, by properly setting the biasing forces of the first spring 704 and the second spring 703, the magnitude and mode of change of the drawing force for drawing the sheet tray 9C can be optimally set.

The attachment assist device 70 according to the present exemplary embodiment includes the first spring 704 and the second spring 703 as the biasing members.

Employing the springs as the biasing members can provide a desired drawing force with an inexpensive configuration.

For the attachment assist device 70 according to the present exemplary embodiment, a target to be drawn is the sheet tray 9C that stores multiple sheets S stacked thereon.

Thus, drawing the sheet tray 9C with the attachment assist device 70 enhances the operability in attaching the sheet tray 9C and allows proper positioning of the sheet tray 9C with respect to the pull-out direction.

For the attachment assist device 70 according to the present exemplary embodiment, a target to which the sheet tray 9C is drawn is the printer 500 described as an example of the image forming apparatus.

Such a configuration enhances the operability in attaching the sheet tray 9C to the printer 500 and allows proper positioning of the sheet tray 9C with respect to the pull-out direction.

The printer 500 according to the present exemplary embodiment includes the sheet tray 9C detachably attached to the main unit of the printer 500 to stack multiple sheets S thereon, the sheet feed roller 10C that feeds the sheets S stacked on the sheet tray 9C, the image forming unit 200 that forms images on the sheets S fed with the sheet feed roller 10C, and the attachment assist device 70 that draws the sheet tray 9C to the drawing end position of the interior of the printer 500 as a unit.

Such a configuration enhances the operability in attaching the sheet tray 9C to the printer 500 and allows proper positioning of the sheet tray 9C with respect to the pull-out direction.

As described above, the attachment assist device and the image forming apparatus according to the present exemplary embodiment allows proper drawing a component unit to an attachment position without upsizing those devices and useful as an attachment assist device having a mechanism for drawing a sheet tray to a main unit and an image forming apparatus including the attachment assist device.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. An attachment assist device that draws a detachably attachable sub unit from a drawing start position to a drawing end position in an interior of a main unit, comprising:

an engaging member provided at one of the main unit and the sub unit;

an engaged member engaged by the engaging member and provided at the other of the main unit and the sub unit;

a drawing-force generator that, on engagement of the engaging member with the engaged member at the drawing start position, generates a drawing force to draw the sub unit to the drawing end position in the interior of the main unit;

a plurality of rotational members, including at least a first rotational member and a second rotational member, each rotational member supported rotatably by a support point at the drawing-force generator; and a plurality of biasing members including at least a first biasing member and a second biasing member provided at the drawing-force generator to generate biasing forces, wherein the first biasing member is connected to a first end of the first rotating member to rotate the first rotating member in one of a counterclockwise direction and a clockwise direction, the second biasing member connected to a second end of the first rotating member to rotate the first rotating member in the other of the counterclockwise direction and the clockwise direction, and the second end of the second biasing member connected to a first end of the second rotating member, and the first and second biasing members serially connected with the first and second rotational members to convert the biasing forces of the first and second biasing members to the drawing force.

2. The attachment assist device according to claim 1, further comprising a regulation member connected to the rotational members via gears so that a drive force of the regulation member is transmittable to the rotational members, wherein, from the drawing start position to the drawing end position, the regulation member generates a load in accordance with a rotation speed of the rotational members to regulate rotation of the rotational members as the sub unit is drawn to the main unit and the rotational members rotate.

3. The attachment assist device according to claim 2, wherein engagement positions between the biasing members and the rotational members and relative positions of the biasing members and the rotational members are set to generate one of a first drawing force for drawing the sub unit at relatively high speed and a second drawing force for drawing the sub unit at relatively low speed.

4. The attachment assist device according to claim 3, wherein the engagement positions between the biasing members and the rotational members and the relative positions of the biasing members and the rotational members are set to generate the second drawing force at the drawing start position and the first drawing force in an area other than the drawing start position.

5. The attachment assist device according to claim 3, wherein the engagement positions between the biasing members and the rotational members and the relative positions of the biasing members and the rotational members are set to smoothly shift the drawing force between the first drawing force and the second drawing force.

6. The attachment assist device according to claim 1, wherein one of the engaging member and the engaged member comprises an engagement limiter, the engagement limiter integrally comprising:

a first slot engaged with the other of the engaging member and the engaged member;

a second slot engaged with the other of the engaging member and the engaged member only when the sub unit is not at the drawing end position and the one of the engaging member and the engaged member is at the drawing end position; and a hook portion that limits rotation of the rotational members when the one of the engaging member and the engaged member is at the drawing start position.

7. The attachment assist device according to claim 1, wherein the biasing forces generated by the biasing members are different in magnitude.

8. The attachment assist device according to claim 1, wherein the biasing members are springs.

9. The attachment assist device according to claim 1, wherein the sub unit is a sheet tray that stacks a plurality of recording sheets.

10. The attachment assist device according to claim 1, wherein the main unit is an image forming apparatus.

11. An attachment assist device that draws a detachably attachable sub unit from a drawing start position to a drawing end position in an interior of a main unit, comprising:

an engaging member provided at one of the main unit and the sub unit;

an engaged member engaged by the engaging member and provided at the other of the main unit and the sub unit;

a drawing-force generator that, on engagement of the engaging member with the engaged member at the drawing start position, generates a drawing force to draw the sub unit to the drawing end position in the interior of the main unit;

a plurality of rotational members, including at least a first rotational member and a second rotational member, each rotational member supported rotatably by a support point at the drawing-force generator;

a plurality of biasing members including at least a first biasing member and a second biasing member provided at the drawing-force generator to generate biasing forces, wherein the first biasing member is connected to a first end of the first rotating member to rotate the first rotating member in one of a counterclockwise direction and a clockwise direction, the second biasing member connected to a second end of the first rotating member to rotate the first rotating member in the other of the counterclockwise direction and the clockwise direction, and the second end of the second biasing member connected to a first end of the second rotating member, and the first and second biasing members serially connected with the first and second rotational members to convert the biasing forces of the first and second biasing members to the drawing force;

a regulation member connected to the rotational members via gears so that a drive force of the regulation member is transmittable to the rotational members, wherein, from the drawing start position to the drawing end position, the regulation member generates a load in accordance with a rotation speed of the rotational members to regulate rotation of the rotational members as the sub unit is drawn to the main unit and the rotational members rotate; and a shutoff member that shuts off transmission of the load from the regulation member to the rotational members via gears as the sub unit is pulled toward an exterior of the main unit and the rotational members rotate.

12. An image forming apparatus comprising:

a sheet tray detachably attached to the image forming apparatus to stack a plurality of recording sheets thereon;

a sheet feeder that feeds the recording sheets stacked on the sheet tray;

an image forming unit that forms images on the recording sheets fed with the sheet feeder; and an attachment assist device that draws the sheet tray from a drawing start position to a drawing end position in an interior of the image forming apparatus; the attachment assist device comprising:

an engaging member provided at one of the main unit and the sub unit; an engaged member engaged by the engaging member and provided at the other of the main unit and the sub unit;

a drawing-force generator that, on engagement of the engaging member with the engaged member at the drawing start position, generates a drawing force to draw the sub unit to the drawing end position in the interior of the main unit;

a plurality of rotational members, including at least a first rotational member and a second rotational member, each rotational member supported rotatably by a support point at the drawing-force generator; and a plurality of biasing members including at least a first biasing member and a second biasing member provided at the drawing-force generator to generate biasing forces, wherein the first biasing member is connected to a first end of the first rotating member to rotate the first rotating member in one of a counterclockwise direction and a clockwise direction, the second biasing member connected to a second end of the first rotating member to rotate the first rotating member in the other of the counterclockwise direction and the clockwise direction, and the second end of the second biasing member connected to a first end of the second rotating member, and the first and second biasing members serially connected with the first and second rotational members to convert the biasing forces of the first and second biasing members to the drawing force.

13. The image forming apparatus according to claim 12, further comprising a regulation member connected to the rotational members via gears so that a drive force of the regulation member is transmittable to the rotational members, wherein, from the drawing start position to the drawing end position, the regulation member generates a load in accordance with a rotation speed of the rotational members to regulate rotation of the rotational members as the sub unit is drawn to the main unit and the rotational members rotate.

14. The image forming apparatus according to claim 12, wherein one of the engaging member and the engaged member comprises an engagement limiter, the engagement limiter integrally comprising:

a first slot engaged with the other of the engaging member and the engaged member;

a second slot engaged with the other of the engaging member and the engaged member only when the sub unit is not at the drawing end position and the one of the engaging member and the engaged member is at the drawing end position; and a hook portion that limits rotation of the rotational members when the one of the engaging member and the engaged member is at the drawing start position.

15. An image forming apparatus comprising:

a sheet tray detachably attached to the image forming apparatus to stack a plurality of recording sheets thereon;

a sheet feeder that feeds the recording sheets stacked on the sheet tray;

an image forming unit that forms images on the recording sheets fed with the sheet feeder; and an attachment assist device that draws the sheet tray from a drawing start position to a drawing end position in an interior of the image forming apparatus; the attachment assist device comprising:

an engaging member provided at one of the main unit and the sub unit; an engaged member engaged by the engaging member and provided at the other of the main unit and the sub unit;

a drawing-force generator that, on engagement of the engaging member with the engaged member at the drawing start position, generates a drawing force to draw the sub unit to the drawing end position in the interior of the main unit;

a plurality of rotational members, including at least a first rotational member and a second rotational member, each rotational member supported rotatably by a support point at the drawing-force generator; and a plurality of biasing members including at least a first biasing member and a second biasing member provided at the drawing-force generator to generate biasing forces, wherein the first biasing member is connected to a first end of the first rotating member to rotate the first rotating member in one of a counterclockwise direction and a clockwise direction, the second biasing member connected to a second end of the first rotating member to rotate the first rotating member in the other of the counterclockwise direction and the clockwise direction, and the second end of the second biasing member connected to a first end of the second rotating member, and the first and second biasing members serially connected with the first and second rotational members to convert the biasing forces of the first and second biasing members to the drawing force; and a shutoff member that shuts off transmission of the load from the regulation member to the rotational members via gears as the sub unit is pulled toward an exterior of the main unit and the rotational members rotate.

* * * * *